US011359295B2

(12) United States Patent
Modestino et al.

(10) Patent No.: US 11,359,295 B2
(45) Date of Patent: Jun. 14, 2022

(54) ELECTROHYDROGENATION OF NITRILES

(71) Applicant: New York University, New York, NY (US)

(72) Inventors: Miguel A. Modestino, New York, NY (US); Daniela Eugenia Blanco, Austin, TX (US); Zainub Aaliyah Imran Dookhith, Noisy-le-Sec (FR)

(73) Assignee: New York University, New York, NY (US)

( * ) Notice: Subject to any disclaimer, the term of this patent is extended or adjusted under 35 U.S.C. 154(b) by 0 days.

(21) Appl. No.: 17/317,413

(22) Filed: May 11, 2021

(65) Prior Publication Data

US 2021/0348283 A1 Nov. 11, 2021

Related U.S. Application Data

(60) Provisional application No. 63/023,173, filed on May 11, 2020.

(51) Int. Cl.

| | |
|---|---|
| ***C25B 3/20*** | (2021.01) |
| ***C25B 3/09*** | (2021.01) |
| ***C25B 9/23*** | (2021.01) |
| ***C25B 11/046*** | (2021.01) |
| ***C25B 11/043*** | (2021.01) |
| ***C25B 13/00*** | (2006.01) |

(52) U.S. Cl.

CPC ..... *C25B 3/20* (2021.01); *C25B 3/09* (2021.01); *C25B 9/23* (2021.01); *C25B 11/043* (2021.01); *C25B 11/046* (2021.01); *C25B 13/00* (2013.01)

(58) Field of Classification Search

None

See application file for complete search history.

(56) References Cited

U.S. PATENT DOCUMENTS 5,266,731 A * 11/1993 Ayers ..... C07C 209/48 564/492

FOREIGN PATENT DOCUMENTS

RU 2218325 C2 * 12/2003

OTHER PUBLICATIONS

Machine translation of Bekenova et al. RU 2218325 (Year: 2003).*

* cited by examiner

*Primary Examiner* — Wojciech Haske

(74) *Attorney, Agent, or Firm* — Hodgson Russ LLP

(57) ABSTRACT

Provided are methods of making aliphatic or aromatic compounds (e.g., small molecules or polymers) having one or more amine groups and/or imine groups. A method of the present disclosure is an electrohydrogenation method, where a potential is applied to an aliphatic or aromatic compound (e.g., small molecule or polymer) having one or more nitrile groups, where after the potential is applied one or more of the nitrile groups are reduced to an amine or imine. The electrohydrogenation may be carried out using non-pulsed or pulsed potential waveforms.

19 Claims, 11 Drawing Sheets

ELECTROHYDROGENATION OF NITRILES

CROSS REFERENCE TO RELATED APPLICATION

This application claims priority to U.S. Provisional Patent Application No. 63/023,173, filed May 11, 2020, the disclosure of which is incorporated herein by reference.

BACKGROUND OF THE DISCLOSURE

Hydrogenations are among the most important chemical transformations in industry. Organic hydrogenations are key steps in the production of numerous valuable chemicals, being responsible for the processing of vegetable oils, sugars, and general conversion of unsaturated compounds into saturated alkanes and organic molecules of value. These normally require high temperature, pressure, may use expensive catalysts (e.g., palladium, ruthenium, rhodium), and entail a series of risks and energy losses associated with transporting, storing, and handling compressed hydrogen. Their requirement for high temperature, pressure, and compressed hydrogen has stirred a strong interest in the development of safer electrohydrogenation routes in benign aqueous electrolytes. However, faradaic efficiencies in organic electrohydrogenations tend to be greatly limited by strong hydrogen evolution and low reactant solubility, which limits the competitiveness and impact of these more sustainable routes.

Electrohydrogenations are a promising alternative, where organic molecules can react with hydrogen obtained from electrochemical water splitting reactions carried out at ambient temperature and pressure. The use of water, instead of hydrogen, as proton source, reduces the risk of handling compressed flammable gases, and eliminates the need for methane reforming—commonly used in hydrogen production. Moreover, the implementation of electrohydrogenations can accelerate the decarbonization of the chemical industry through the use of renewable electricity in chemical manufacturing.

Electrohydrogenations in aqueous media have been reported mostly for unsaturated organic molecules, including the hydrogenation of aromatic compounds, edible oils, quinonemethides, and other olefins. The electroreduction of other oxygenated functional groups (i.e., ethers, ketones, and alcohols) has been studied extensibly, while the electrohydrogenation of nitrile groups has received less attention despite its important implications in chemical manufacturing. The most common industrial route for HMDA production (see FIG. 1) involves a continuous process whereby a mixture of ADN, ammonia, and hydrogen is passed over a catalyst bed or suspension based on Cobalt, Palladium, Nickel, Iron, Ruthenium, Rhodium or Platinum at 90-150° C. and 1-60 MPa.

Previous studies of partial electrohydrogenation of ADN and azelanitrile to their respective aminonitriles showed faradaic efficiencies between 50-60% towards ACN, which can be hydrolyzed to ε-aminocaproic acid, the precursor for nylon 6. Other studies have reported faradaic efficiencies <60% for the electro-hydrogenation of ADN to HMDA in aqueous electrolytes containing HCl, NaOH, or alcohols such as ethanol, or methanol as co-solvents. This type of electrohydrogenations often relies on the use of Raney Nickel electrodes. The limited faradaic efficiencies exhibited by these electrochemical reactions (i.e., <60%) have hindered the viability of electrochemical HMDA production.

Based on the foregoing, there exists and ongoing and unmet need for improved nitrile electrohydrogenation methods.

SUMMARY OF THE DISCLOSURE

The present disclosure provides methods of making compounds, which may aliphatic or aromatic compounds and/or polymers comprising one or more amine group(s). The present disclosure also provides compositions comprising compounds, which may aliphatic or aromatic compounds, and/or polymers comprising one or more amine group(s).

The conversion of adiponitrile (ADN) to hexamethylenediamine (HMDA) is an example of a carbon-nitrogen bond hydrogenation that can be done electrochemically using, for example, Raney Nickel or palladium electrodes. This process can impact the annual production of nearly 2M tons of HMDA, a chemical product used as detergent, insecticide, emulsifying agent, and most importantly, as a monomer in the manufacture of nylon 6,6. It may be further coupled with already existing electrosynthetic routes to manufacture ADN, contributing to the electrification and intensification of the large scale production of nylon 6,6. The risk associated with the high pressure and compressed hydrogen gas inherent of the thermocatalytic ADN hydrogenation routes (FIG. 1) can be avoided by an electrochemical process. The electrohydrogenation of ADN to HMDA proceeds according to the reaction scheme showed in FIG. 1, with 6-aminocapronitrile (ACN) and hydrogen as the main reaction by-products. However, it was unexpectedly found that the use of the methods of the present disclosure led to significant improvements in energy efficiency and reaction selectivity in organic electro-reductions. Without intending to be bound by any particular theory it is considered that controlling the near-electrode environment promoted production of HMDA over other by-products.

In an aspect, the present disclosure provides methods of making compounds (e.g., products), which may aliphatic or aromatic products, and/or polymers comprising one or more amine group(s). The methods are based on electrohydrogenation of aliphatic compounds comprising one or more nitrile groups using electrolyte compositions of the present disclosure. A method may selectively hydrogenate a portion of or all of the nitrile groups. The electrohydrogenation may be carried out using non-pulsed or pulsed potential waveforms. Non-limiting examples of the methods are described herein.

In an aspect, the present disclosure provides compositions comprising aliphatic compounds (e.g., products of a method of the present disclosure) comprising one or more amine groups (examples of which are described herein). A composition may be produced by a method of the present disclosure. A composition may be an electrochemically produced organic phase composition.

BRIEF DESCRIPTION OF THE FIGURES

For a fuller understanding of the nature and objects of the disclosure, reference should be made to the following detailed description taken in conjunction with the accompanying figures.

DETAILED DESCRIPTION OF THE DISCLOSURE

Figure 1:
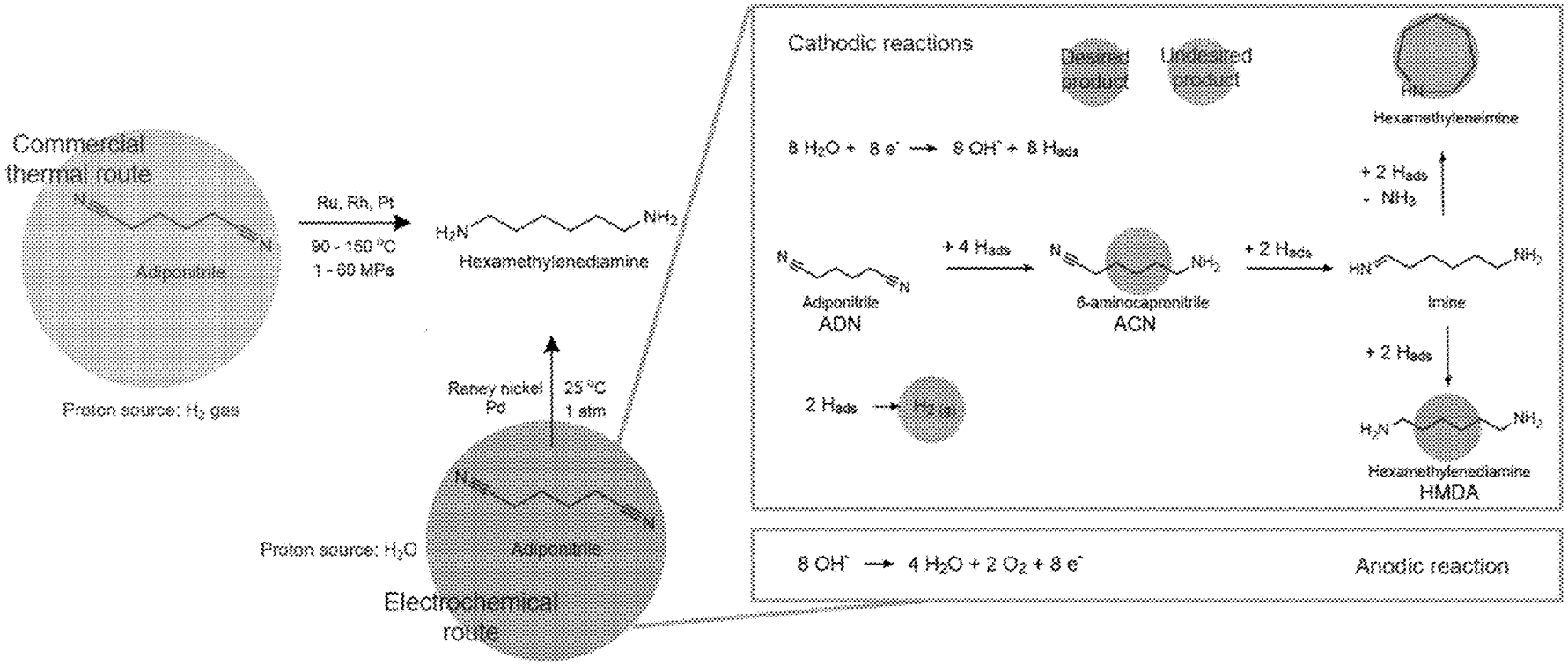
FIG. 1 shows main HMDA production routes and proposed reaction pathway for the electro-hydrogenation of ADN to HMDA.

Although subject matter of the present disclosure is described in terms of certain embodiments and examples, other embodiments and examples, including embodiments and examples that do not provide all of the benefits and features set forth herein, are also within the scope of this disclosure. For example, various structural, logical, process step, and electronic changes may be made without departing from the scope of the disclosure.

The present disclosure provides methods of making compounds (e.g., products), which may aliphatic or aromatic compounds and/or polymers comprising one or more amine group(s). The present disclosure also provides compositions comprising compounds, which may aliphatic or aromatic compounds, and/or polymers comprising one or more amine group(s).

Ranges of values are disclosed herein. The ranges set out a lower limit value and an upper limit value. Unless otherwise stated, the ranges include all values to the magnitude of a value, which may be the smallest value, of the stated range (e.g., either lower limit value or upper limit value) and all ranges between the values of the stated range.

As used herein, unless otherwise indicated, the term "group" refers to a chemical entity that is monovalent (i.e., has one terminus that can be covalently bonded to other chemical species), divalent, or polyvalent (i.e., has two or more termini that can be covalently bonded to other chemical species). The term "group" also includes radicals (e.g., monovalent radicals and multivalent radicals, such as, for example, divalent radicals, trivalent radicals, and the like). Examples of groups include, but are not limited to:

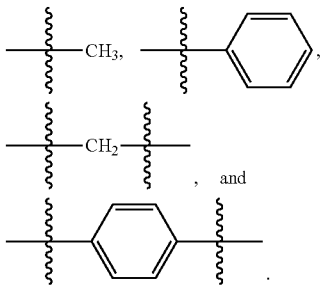

As used herein, unless otherwise indicated, the term "alkyl group" refers to branched or unbranched saturated hydrocarbon groups. Examples of alkyl groups include, but are not limited to, methyl groups, ethyl groups, propyl groups, butyl groups, isopropyl groups, tert-butyl groups, and the like. For example, an alkyl group is a $C_1$ to $C_{50}$ alkyl group (e.g., $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$, $C_{36}$, $C_{37}$, $C_{38}$, $C_{39}$, $C_{40}$, $C_{41}$, $C_{42}$, $C_{43}$, $C_{44}$, $C_{45}$, $C_{46}$, $C_{47}$, $C_{48}$, $C_{49}$, or $C_{50}$ alkyl group), including all integer numbers of carbons and ranges of numbers of carbons therebetween. The alkyl group may be unsubstituted or substituted with one or more substituent. Examples of substituents include, but are not limited to, halogens (—F, —Cl, —Br, and —I), aliphatic groups (e.g., alkyl groups, alkenyl groups, alkynyl groups, and the like), halogenated aliphatic groups (e.g., trifluoromethyl group), aryl groups, halogenated aryl groups, alkoxide groups, amine groups, nitro groups, carboxylate groups, carboxylic acids, ether groups, alcohol groups, alkyne groups (e.g., acetylenyl groups and the like), and the like, and combinations thereof.

As used herein, unless otherwise indicated, the term "aliphatic" refers to branched or unbranched hydrocarbon groups that, optionally, contain one or more degrees of unsaturation. Degrees of unsaturation include, but are not limited to, alkenyl groups, alkynyl groups, and cyclic aliphatic groups. For example, an aliphatic group is a $C_1$ to $C_{50}$ aliphatic group (e.g., $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$, $C_{36}$, $C_{37}$, $C_{38}$, $C_{39}$, $C_{40}$, $C_{41}$, $C_{42}$, $C_{43}$, $C_{44}$, $C_{45}$, $C_{46}$, $C_{47}$, $C_{48}$, $C_{49}$, or $C_{50}$ aliphatic group), including all integer numbers of carbons and ranges of numbers of carbons therebetween. The aliphatic group can be unsubstituted or substituted with one or more substituent. Examples of substituents include, but are not limited to, halogens (—F, —Cl, —Br, and —I), aliphatic groups (e.g., alkyl groups, alkenyl groups, alkynyl groups, and the like), halogenated aliphatic groups (e.g., trifluoromethyl group), aryl groups, halogenated aryl groups, alkoxide groups, amine groups, nitro groups, carboxylate groups, carboxylic acids, ether groups, alcohol groups, alkyne groups (e.g., acetylenyl groups and the like), and the like, and combinations thereof.

As used herein, unless otherwise indicated, the term "aryl group" refers to As used herein, unless otherwise indicated, the term "aryl group" refers to $C_5$ to $C_{30}$ aromatic or partially aromatic carbocyclic groups, including all integer numbers of carbons and ranges of numbers of carbons therebetween (e.g., $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, or $C_{30}$). An aryl group can also be referred to as an aromatic group. The aryl groups can comprise polyaryl groups such as, for example, fused ring or biaryl groups. The aryl group can be unsubstituted or substituted with one or more substituent. Examples of substituents include, but are not limited to, substituents such as, for example, halogens (e.g., —F, —Cl, —Br, and —I), aliphatic groups (e.g., alkyl groups, alkenyl groups, and alkynyl groups), aryl groups, alkoxide groups, carboxylate groups, carboxylic acids, ether groups, alcohol groups, amine groups, thiol groups, thioether groups, and the like, and combinations thereof. Examples of aryl groups include, but are not limited to, phenyl groups, biaryl groups (e.g., biphenyl groups and the like), and fused ring groups (e.g., naphthyl groups and the like).

The conversion of adiponitrile (ADN) to hexamethylenediamine (HMDA) is an example of a carbon-nitrogen bond hydrogenation that can be done electrochemically using, for example, Raney Nickel or palladium electrodes. This process can impact the annual production of nearly 2M tons of HMDA, a chemical product used as detergent, insecticide, emulsifying agent, and most importantly, as a monomer in the manufacture of nylon 6,6. It may be further coupled with already existing electrosynthetic routes to manufacture ADN, contributing to the electrification and intensification of the large scale production of nylon 6,6. The risk associated with the high pressure and compressed hydrogen gas inherent of the thermocatalytic ADN hydrogenation routes (FIG. 1) can be avoided by an electrochemical process. The electrohydrogenation of ADN to HMDA proceeds according to the reaction scheme showed in FIG. 1, with 6-aminocapronitrile (ACN) and hydrogen as the main reaction by-products. However, it was unexpectedly found that the use of the methods of the present disclosure led to significant improvements in energy efficiency and reaction selectivity in organic electro-reductions. Without intending to be bound by any particular theory it is considered that controlling the near-electrode environment promoted production of HMDA over other by-products.

In an aspect, the present disclosure provides methods of making compounds (e.g., products), which may aliphatic or aromatic compounds, which may be small molecules comprising one or more amine group(s) or polymers comprising one or more amine group(s) and/or imine group(s). The methods are based on electrohydrogenation of aliphatic compounds comprising one or more nitrile groups using electrolyte compositions of the present disclosure. A method may selectively hydrogenate a portion of or all of the nitrile groups. The electrohydrogenation may be carried out using non-pulsed or pulsed potential waveforms. Non-limiting examples of the methods are described herein.

As a non-limiting illustrative example, a method produces hexamethylenediamine (HMDA) by electrolysis of adiponitrile (ADN). A pathway for the electrohydrogenation of adiponitrile to hexamethylene diamine, including anodic reaction and cathodic side reactions is shown in FIG. 1. Without intending to be bound by any particular theory, it is considered use of an electrolyte composition of the present disclosure provides desirable selectivity for nitrile hydrogenated product(s) (e.g., aliphatic compounds comprising one or more amine group(s)).

A method (e.g., an electrohydrogenation method) may comprise electrolyzing a reaction mixture (e.g., a solution), where the reaction mixture, includes, but is not limited to, compounds, which may aliphatic or aromatic compounds, and/or polymers comprising one or more nitrile group(s), one or more buffer(s), one or more ion chelator(s), one or more tetraalkyl amine(s), and water. The electrolyte comprises specific amounts of buffer(s), ion chelator(s), and tetraalkyl amine(s), and water may make up the remainder of the electrolyte. The reaction mixture is in contact with a cathode. The cathode may have a cathode potential sufficient to electrohydrogenate the aliphatic compound(s) comprising one or more nitrile group(s) to form aliphatic compound(s) comprising one or more amine group(s).

The reaction mixture may have multiple phases. In various examples, a reaction mixture has an aqueous phase and an organic phase.

A reaction mixture may have various pH values. The pH level may be the same (e.g., held constant) during the reaction or change during the reaction. A reaction mixture may have at least an initial pH of 7 to 13, including all 0.1 pH values and ranges therebetween. In the case of adiponitrile, it may be desirable to use a pH of 9-13.

Various compounds, which may aliphatic or aromatic compounds, and/or polymers comprising one or more nitrile groups (which may be referred to as a reactant or reactants) can be used in the methods. Combinations of aliphatic compound(s) and/or aromatic compound(s) and/or polymer(s) may be used. An aliphatic compound may be a $C_1$ to $C_{50}$ aliphatic compound (e.g., $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$, $C_{36}$, $C_{37}$, $C_{38}$, $C_{39}$, $C_{40}$, $C_{41}$, $C_{42}$, $C_{43}$, $C_{44}$, $C_{45}$, $C_{46}$, $C_{47}$, $C_{48}$, $C_{49}$, or $C_{50}$ aliphatic group), including all integer number of carbons and ranges therebetween, and may have one or more carbon-carbon double bond and/or carbon-carbon triple bond, which are independently a terminal or internal carbon-carbon double bond or carbon-carbon triple bond. The aliphatic compound(s) may be a mono-, di-, or tri-nitrile compound comprising one, two, or three nitrile group(s), respectively. An aromatic compound may be a $C_5$ to $C_{30}$, aromatic compound (e.g., $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, or $C_{30}$), including all integer number of carbons and ranges therebetween. The aromatic compound(s) may be a mono-, di-, or tri-nitrile compound comprising one, two, or three nitrile group(s), respectively. A reactant may be a polymer comprising a plurality of nitrile groups. Examples of reactants include, but are not limited to, adiponitrile, azelanitrile, butyronitrile, aminocapronitrile, polynitriles, and the like, and combinations thereof. A compound may be a small molecule or polymer.

A product may be an aliphatic compound comprising or more amine group(s). The aliphatic compound may be a $C_1$ to $C_{50}$ aliphatic compound (e.g., $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$, $C_{36}$, $C_{37}$, $C_{38}$, $C_{39}$, $C_{40}$, $C_{41}$, $C_{42}$, $C_{43}$, $C_{44}$, $C_{45}$, $C_{46}$, $C_{47}$, $C_{48}$, $C_{49}$, or $C_{50}$ aliphatic group), including all integer number of carbons and ranges therebetween, and may have one or more terminal or internal carbon-carbon double bond and/or carbon-carbon triple bond. The aliphatic compound(s) may be a mono-, di-, or tri-amine compound comprising one, two, or three amine group(s), respectively. Examples of products include, but are not limited to, hexamethylene diamine, aminocapronitrile, 9-aminononanenitrile, 1,9-diaminononononane, 1,4-diaminobutane, and the like, and combinations thereof.

Non-limiting examples of suitable aliphatic compounds comprising one or more nitrile groups may have the following structure:

(Formula I)

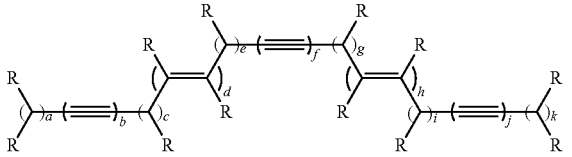

where individually, each a, c, e, g, i, and k are 0-50 and individually, each b, d, f, h, and j are 0-25, where the total of number of carbons are 50 or less, and each R is individually selected from H or a substituent described herein and at least one R is a nitrile. In the case of these aliphatic compounds, the product of the method would have the following structure:

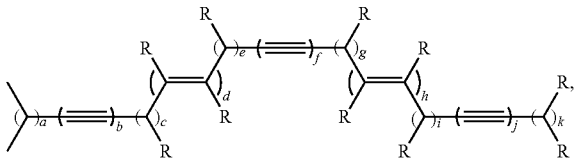

where one or more or all R groups that were nitriles in Formula I are reduced to an amine or imine. Examples of suitable aliphatic compounds comprising one or more nitrile groups may have the following structure:

(Formula II)

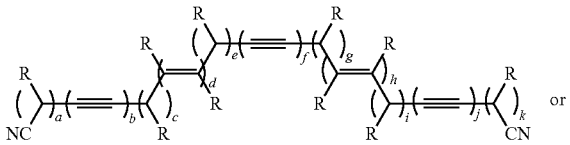

or (Formula III)

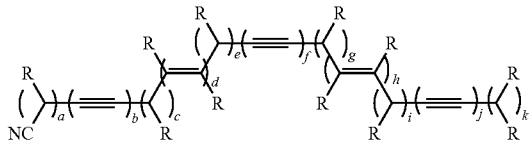

where individually, each a, c, e, g, i, and k are 0-50 and individually, each b, d, f, h, and j are 0-25, where the total of number of carbons are 50 or less, and each R is individually selected from H or a substituent described herein. In the case of these aliphatic compounds, the product of the method would have the following structure:

(Formula IV-a)

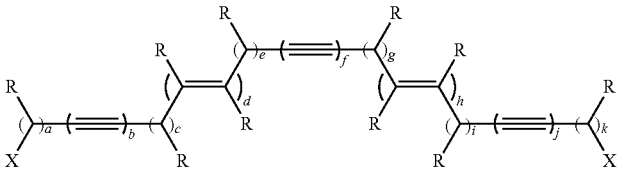

(Formula IV-b)

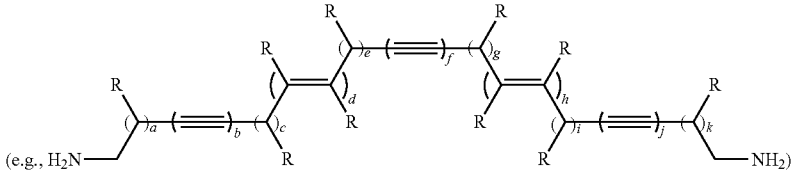

or

-continued (Formula V-a)

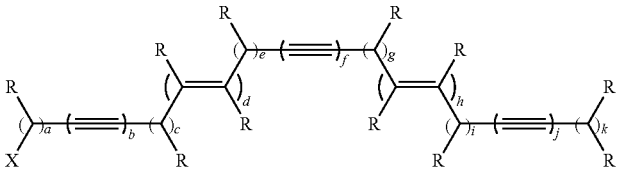

(Formula V-b)

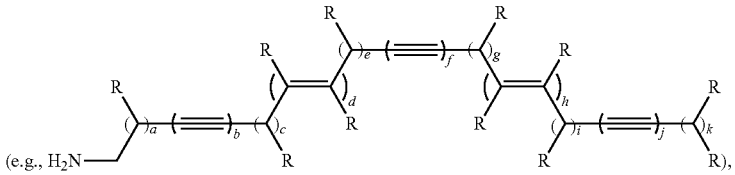

where one or more or all R groups that were nitriles are reduced to an amine or imine and each X is individually an —$CH_2NH_2$ or —CH═NH. An aliphatic compound comprising one or more nitriles of the present disclosure may have the following structure:

(Formula VI)

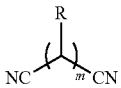

or (Formula VII)

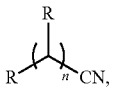

where m and n are 1-50 (1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50) and each R is individually selected from H or a substituent described herein (e.g., an ether, nitrile, and the like, and combinations thereof). The corresponding products would have the following structure:

(Formula VIII-a)

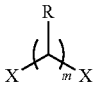

(Formula VIII-b)

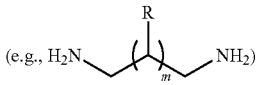

(Formula IX-a)

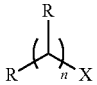

(Formula IX-b)

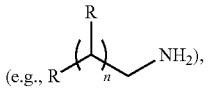

where one or more or all R groups that were nitriles are reduced to an amine or imine and each X is individually an —$CH_2NH_2$ or —CH═NH.

The electrolysis may be carried out using a non-pulsed potential waveform applied to the cathode. The electrolysis may be carried out using a pulsed potential waveform applied to the cathode. The cathode may have for a selected duration/durations a cathode potential sufficient to electrohydrogenate the aliphatic compound(s) comprising one or more nitrile groups and for selected duration/other selected durations a higher cathode potential at which the hydrogenation of the aliphatic compound(s) either occurs at a slower rate or is completely suppressed.

Various pulsed waveforms may be used for the potential applied to the cathode (with respect to the reference electrode)—for example, pulsing from a base potential to a cathodic potential (and optionally, back). A waveform may comprise one or more pulses. A method may comprise applying a potential with a waveform having a plurality of pulses having the same base potential, the same cathodic potential, the same resting duration, the same cathodic potential, or combinations of these. For example, for individual pulses, the base potential may be the same as all the other pulses or may be different than one or more of the other pulses. A waveform may comprise two or more different pulses (e.g., having different base and/or cathodic potentials and/or durations). An individual pulse may have a cathodic potential of 0V to −4V (e.g., measured against a reference electrode, such as, for example, a Ag/AgCl reference electrode). The cathodic potential may be constant or vary for at least a portion or all of the cathodic duration. For example, the cathodic potential is in the form of a sine wave, a square wave, a triangle wave, a saw-tooth wave, and the like. Similarly, the base potential may be constant or vary for at least a portion or all of the resting duration. For example, the base potential is in the form of a sine wave, a square wave, a triangle wave, a saw-tooth wave, and the like.

A method may be carried out at various pHs and/or temperatures. A method may be carried out a pH 7 to 13, including all 0.1 pH values and ranges therebetween, and/or a temperature of 20-80° C., including all integer ° C. values and ranges therebetween.

A method may be carried out in a batch mode (e.g., using a closed system). A method may be carried out in a continuous/semi-continuous mode (e.g., using a flow system).

Without intending to be bound by any particular theory, it is considered that a method of the present disclosure produces more aliphatic compounds comprising one or more amines(s) (e.g., hexamethylene diamine) relative to the same method carried out using an electrolyte not described herein. A method of the present disclosure may produce 20% or more, 30% or more, 40% or more, 50% or more, 60% or more, 70% or more, 80% or more, 90% or more, or 100% or more, aliphatic compounds comprising one or more amine group(s) (e.g., hexamethylene diamine) and/or one or more imine group(s) relative to the same method carried out using an electrolyte not described herein.

A method may provide desirable product production rate and/or selectivity. The product production rate of a pulsed-potential method may be at least 10%, at least 20%, at least 30%, at least 40%, at least 50%, at least 75%, or at least 100% greater relative to the same method carried out using DC electrolysis and/or a method may result in at least 10%, at least 20%, at least 30%, at least 40%, at least 50%, at least 75%, or 100% reduction in one or more undesirable products relative to the same method carried out using an electrolyte not described herein.

In an aspect, the present disclosure provides compositions comprising aliphatic compounds comprising one or more amine groups (examples of which are described herein). A composition may be produced by a method of the present disclosure. A composition may be an electrochemically produced organic phase composition.

A composition (e.g., an electrochemically produced organic phase composition) comprising one or more compound(s), which may aliphatic and/or aromatic compounds, comprising one or more amine(s) (e.g., hexamethylene diamine) and/or one or more imine(s) and/or polymers comprising one or more amine group(s) and/or one or more imine(s) at a concentration of 1 to 100 wt %, including all 0.1 weight percent values and ranges therebetween; one or more aliphatic compound comprising one or more nitrile group(s) (e.g., adiponitrile, azelanitrile, butyronitrile, aminocapronitrile, polynitriles, and the like, and combinations thereof) at a concentration of 0 to 85 wt %, including all 0.1 weight percent values and ranges therebetween. A composition may comprise one or more undesirable products (e.g., partially hydrogenated products (less than all of the nitrile groups are hydrogenated, such as, for example, 6-aminocapronitrile, hexamethyleneimine, 9-aminononanenitrile, and the like, or a combination thereof) at a concentration of 0 to 30 wt %, including all 0.1 weight percent values and ranges therebetween. A composition may not have been subjected to any purification and/or separation (e.g., removal of the one or more aliphatic compound comprising two or more nitrile groups (e.g., adiponitrile and the like) and/or one or more aliphatic compound comprising one or more amine groups (e.g., hexamethylenediamine, and the like) and/or or undesirable products) after electrochemical production of the adiponitrile. The wt % is relative to the total weight of the composition.

A composition may comprise one or more undesirable products at a concentration of less than 30 wt %, less than 25 wt %, less than 20 wt %, or less than 15 wt %, where composition has not been subjected to any separation (e.g., removal of hexamethylene diamine and/or adiponitrile and/or undesirable products) after electrochemical production of the aliphatic compound(s) comprising one or more amine group(s) (e.g., a product such as, for example, hexamethylene diamine and the like). The undesirable products may be those related to hydrogen evolution, partial electrohydrogenation of nitrile groups to imines, cyclization of chains and/or undesired bulk reactions. One skilled in the art would recognize undesirable products that may result from electrohydrogenation of other aliphatic compounds comprising one or more nitrile group(s), which may be based on the application. The wt % is relative to the total weight of the composition.

The steps of the method described in the various embodiments and examples disclosed herein are sufficient to carry out the methods of the present disclosure. Thus, in various examples, a method consists essentially of a combination of steps of the methods disclosed herein. In various other examples, a method consists of such steps.

The following Statements provide Examples of the present disclosure:

Statement 1. A method (e.g., an electrohydrogenation method) for making a product (e.g., one or more compound(s), which may aliphatic and/or aromatic compound(s), and/or polymers, each compound comprising one or more amine group(s), such as, for example, hexamethylene diamine) and/or one or more imine group(s) comprising: electrolyzing a reaction mixture (e.g., a solution) comprising: one or more compound(s), which may aliphatic and/or aromatic compound(s), comprising one or more nitrile(s) and/or polymers comprising one or more nitrile group(s) (e.g., adiponitrile); an electrolyte comprising a buffer; an ion chelator; a tetraalkyl amine; and water; wherein the reaction mixture has at least an initial pH of 7 to 13, wherein the reaction mixture is in contact with a cathode (e.g., a cathode having for selected duration at least one cathode potential sufficient to hydrogenate the aliphatic compound(s), comprising one or more nitrile group(s), and wherein the product is hydrogenated aliphatic compound(s) comprising one or more amine group(s) (e.g., aliphatic compound(s), each compound comprising one or more amine group(s) (e.g., hexamethylene diamine). The method may be carried out in a batch mode (e.g., a closed system) or a continuous/semi-continuous mode (e.g., a flow system). As a non-limiting and illustrative example, adioponitrile is electrohydrogenated to form hexamethylene diamine. The hydrogenation of the aliphatic compound(s), each compound comprising one or more nitrile group(s), may be carried out with desirable selectivity for hydrogenation of the nitrile group(s).

Statement 2. A method according to Statement 1, wherein the aliphatic compounds(s) comprising one or more nitrile groups is/are chosen from adiponitrile, azelanitrile, butyronitrile, and the like, and combinations thereof.

Statement 3. A method according to Statements 1 or 2, wherein the aliphatic compound(s) comprising one or more nitrile group(s) is/are at least initially present in the reaction mixture at a concentration of 3 to 35 wt %, including all 0.1 weight percent values and ranges therebetween. Desirable production rates of hexamethylenediamine (electrohydrogenating adiponitrile) was achieved using adiponitrile at least initially present at 5-15 wt %.

Statement 4. A method according to any one of the preceding Statements, wherein the buffer is chosen from phosphate buffers, acetate buffers, borate buffers, and the like, and combinations thereof.

Statement 5. A method according to any one of the preceding Statements, wherein the buffer salt concentration is 5 to 20 wt % (based on the total weight of the electrolyte), including all 0.1 weight percent values and ranges therebetween.

Statement 6. A method according to any one of the preceding Statements, wherein the ion chelator(s) is/are chosen from ethylene diamine tetraacetic acid/tetraacetate (EDTA), borax, and the like, and combinations thereof.

Statement 7. A method according to any one of the preceding Statements, wherein the ion chelator(s) is/are at least initially present in the reaction mixture at a concentration of 0.1 to 5 wt % (based on the total weight of the electrolyte), including all 0.1 weight percent values and ranges therebetween.

Statement 8. A method of any one of the preceding Statements, wherein the tetraalkyl amine(s) is/are chosen from $R_4N^+A^-$, wherein R is independently at each occurrence an $C_1$, $C_2$, $C_3$, $C_4$, $C_5$, or $C_6$ alkyl group and $A^-$ is an anion chosen from hydroxide, phosphate, acetate, chloride, and the like, and combinations thereof. In various examples, the tetraalkyl amine(s) is/are tetramethylammonium, tetraethyl ammonium, tetrabutylammonium, and the like, and combinations thereof. Without intending to be bound by any particular theory, it is considered that the tetraalkyl amine increases the selectivity of the electrohydrogenation reaction by, for example, increasing the solubility of the aliphatic compound(s) comprising one or more nitrile group(s) and/or forming a layer on at least a portion of a surface of the cathode, which prevents undesirable reaction(s) at a surface of the electrode.

Statement 9. A method according to any one of the preceding Statements, wherein the tetraalkyl amine(s) is/are at least initially present in the reaction mixture at a concentration of 0.1 to 5 wt % (based on the total weight of the electrolyte), including all 0.1 weight percent values and ranges therebetween.

Statement 10. A method according to any one of the preceding Statements, wherein the one or more aliphatic compound(s), each compound comprising one or more nitrile group(s) (e.g., adiponitrile) is adiponitrile and the adiponitrile is at least initially present in the reaction mixture at a concentration of 3 to 35 wt % (based on the total weight of the electrolyte), the buffer is a phosphate buffer; the ion chelator is EDTA and the EDTA is at least initially present in the reaction mixture at a concentration of 0.1 to 5 wt % (based on the total weight of the electrolyte); the tetraalkyl amine is tetramethyl ammonium hydroxide and the tetraalkyl amine is at least initially present in the reaction mixture at a concentration of 0.1 to 5 wt % (based on the total weight of the electrolyte); and the remainder of the electrolyte may be water.

Statement 11. A method according to any one of the preceding Statements, wherein the aliphatic compounds(s) comprising one or more nitrile groups concentration and/or ion chelator(s) and/or trialkyl amine(s) and/or pH is constant or changes as a function of time.

Statement 12. A method according to any one of the preceding claims, wherein the electrohydrogenation reaction is carried out with current densities of 10-1,000 mA $cm^{-2}$, including all 0.1 mA $cm^{-2}$ values and ranges therebetween.

Statement 13. A method according to any one of the preceding Statements, wherein the reaction mixture is in contact with a cathode (e.g., a cathode having for selected duration at least one cathode potential sufficient to electrohydrogenate the one or more aliphatic compound(s) comprising one or more nitrile group (e.g., adiponitrile) and for at least one other selected duration a higher cathode potential at which the electrohydrogenation of the one or more aliphatic olefinic compound(s) comprising one or more nitrile group(s) either occurs at a slower rate or is completely suppressed), and the electrolysis is carried out using a pulsed potential or constant potential waveform applied to the cathode, and wherein the product is a hydrogenation product of the one or more aliphatic olefinic compound(s) comprising one or more nitrile group(s).

Statement 14. A method according to any one of the preceding Statements, wherein the electrohydrogenation is carried out using a pulsed potential waveform (e.g., the pulsed potential waveform has a base (resting) potential (e.g., selected within a range where no faradaic reaction occurs or occurs at a lower rate than during the cathodic potential) and at least one cathodic (pulse) potential (in each case, potential is measured with respect to another electrode (e.g., an anode or reference electrode)). The base potential may be applied for a resting duration of less than 50 ms (e.g., between 0.1 ms to 50 ms, inclusive) and the cathodic potential is applied for a cathodic duration of between 5 ms and 2000 ms, inclusive. The pulsed potential waveform may alternate between the base potential and the cathodic potential. The base potential may have same potential value as each other instance of the base potential and/or each instance of the cathodic potential has a same potential value as each other instance of the cathodic potential. Each resting duration may be the same as each other resting duration and/or each cathodic duration is the same as each other cathodic duration. In various examples, each base potential is the same or varies in the range between 0 V and −4 V measured against a Ag/AgCl reference electrode, inclusive, and/or the cathodic potential is equal to or lower than (i.e., more negative than) −2 V (e.g., measured against, for example, a Ag/AgCl reference electrode) and may vary throughout the electrolysis. The base potential of a pulse may be constant throughout the resting duration and/or the cathodic potential of a pulse is constant throughout the cathodic duration. The base potential of a pulse varies during the resting duration and/or the cathodic potential of a pulse varies during the cathodic duration. In various examples, the base potential of a pulse varies (e.g., as a sine wave, a square wave, triangle wave, a saw-tooth wave, ramp up, ramp down, etc.) during the resting duration and/or the cathodic potential of a pulse varies (e.g., as a sine wave, a square wave, triangle wave, a saw-tooth wave, ramp up, ramp down, etc.) during the cathodic duration.

Statement 15. A method according to any one of the preceding Statements, wherein the electrohydrogenation is carried out in an electrochemical cell (which may be a single compartment cell or a divided electrochemical cell) comprising the cathode. The electrochemical cell may be a static cell or flow cell.

Statement 16. A method according to any one of the preceding Statements, wherein the electrochemical cell further comprises a metal anode (e.g., an anode comprising nickel, carbon steel, a platinum iridium-based dimensionally stable anode material, or the like) and, optionally, a reference electrode.

Statement 17. A method according to any one of the preceding Statements, wherein the electrochemical cell further comprises a separator (e.g., a cation-exchange, anion-exchange, or bipolar membrane separating a cathode half-cell and an anode half-cell which are in electrical contact).

Statement 18. A method according to any one of the preceding Statements, wherein the cathode has an electrochemically available surface (e.g., an exterior surface) comprising a metal (e.g., nickel, Raney nickel, palladium, cadmium, lead, gold, copper, silver, platinum, boron-doped diamond, iridium, carbon steel, and the like), carbon, or a combination thereof.

Statement 19. A method according to any one of the preceding Statements, further comprising separation at least a portion of, substantially all, or all of the adiponitrile from the reaction mixture. Illustrative, non-limiting examples of separation methods include distillation, liquid-liquid decantation to separate the aqueous from the organic phase, and the like.

Statement 20. A method of any one of the preceding Statements, further comprising varying the amount of aliphatic compound(s) comprising one or more amine group(s) (e.g., hexamethylene diamine) and/or undesirable products (e.g., aminocapronitrile, hexamethyleneimine, and the like, or a combination thereof) produced by adjusting one or more of: i) concentration of aliphatic compound(s) comprising one or more nitrile group(s) (e.g., adiponitrile), ii) buffer concentration, iii) ion chelator(s), iv) tetraalkyl amine(s), v) pH, and vi) temperature.

Statement 21. A composition (e.g., an electrochemically produced organic phase composition) comprising: one or more aliphatic compound(s) comprising one or more amine group(s) (e.g., hexamethylamine diamine), which may be a product, at a concentration of 1 to 100 wt % (based the total weight of the composition), including all 0.1 weight percent values and ranges therebetween; one or more aliphatic compound(s) comprising one or more nitrile group(s) (e.g., adiponitrile) at a concentration of 0 to 85 wt % (based the total weight of the composition), including all 0.1 weight percent values and ranges therebetween; and undesirable products (e.g., aminocapronitrile, hexamethyleneimine, and the like, or a combination thereof) at a concentration of 0 to 50 wt % (based the total weight of the composition), including all 0.1 weight percent values and ranges therebetween, wherein the electrochemically produced composition has not been subjected to any separation (e.g., removal of one or more aliphatic compound(s) comprising one or more amine group(s) (e.g., hexamethylamine diamine) and/or one or more aliphatic compound(s) comprising one or more nitrile group(s) (e.g., adiponitrile) and/or or undesirable product(s)) after electrochemical production of the one or more aliphatic compound(s) comprising one or more amine group(s) (e.g., adiponitrile). The composition may be produced by a method of the present disclosure (e.g., a method of any one of Statements 1-20).

Statement 22. A electrohydrogenation method for making an compound comprising one or more amine groups and/or imine groups, wherein the compound comprising one or more amine groups and/or imine groups is aliphatic or aromatic, comprising: contacting a reaction mixture having an initial pH of 7 to 13 with a cathode, wherein the reaction mixture comprises: one or more aliphatic or aromatic compounds comprising one or more nitriles at an initial concentration of 3-35 wt %, including all 0.1 wt % values and ranges therebetween; and an electrolyte comprising a buffer salt; an ion chelator; a tetraalkyl amine; and water; and applying a potential with a current density of 10-1,000 mA $cm^{-2}$, including all 0.1 mA $cm^{-2}$ values and ranges therebetween to the cathode, wherein at least one nitrile of the one or more aliphatic or aromatic compounds are hydrogenated such that one or more amine group(s) and/or imine group(s) are formed.

Statement 23. A method according to Statement 22, wherein the aliphatic or aromatic compound comprising one or more nitriles is a small molecule or a polymer.

Statement 24. A method according to Statements 22 or 23, wherein the aliphatic or aromatic compound comprising one or more nitriles is aliphatic and is chosen from adiponitrile, azelanitrile, butyronitrile, and the like, and combinations thereof.

Statement 25. A method according to Statement 24, wherein the aliphatic or aromatic compound comprising one or more nitriles is adioponitrile.

Statement 26. A method according to Statement 25, wherein the initial concentration of the aliphatic or aromatic compound comprising one or more nitriles is 5-15 wt %, including all 0.1 wt % values and ranges therebetween.

Statement 27. A method according to any one of Statements 22-26, wherein the buffer salt is chosen from phosphate buffers, acetate buffers, borate buffers, and combinations thereof and the buffer salt concentration is 5 to 20 wt % (based on the total weight of the electrolyte), including all 0.1 wt % values and ranges therebetween.

Statement 28. A method according to any one of Statements 22-27, wherein the ion chelator is chosen from ethylene diamine tetraacetic acid/tetraacetate (EDTA), borax, and the like, and combinations thereof and the ion chelator is at least initially present in the reaction mixture at a concentration of 0.1-5 wt % (based on the total weight of the electrolyte), including all 0.1 wt % values and ranges therebetween.

Statement 29. A method according to any one of Statements 22-28, wherein the tetraalkyl amine is chosen from $R_4N^+A^-$, wherein R is independently at each occurrence an $C_1$, $C_2$, $C_3$, $C_4$, $C_5$, or $C_6$ alkyl group and $A^-$ is an anion chosen from hydroxide, phosphate, acetate, chloride, and the like, and combinations thereof.

Statement 30. A method according to Statement 29, wherein the tetraalkyl amine is at least initially present in the reaction mixture at a concentration of 0.1-5 wt % (based on the total weight of the electrolyte), including all 0.1 wt % values and ranges therebetween.

Statement 31. A method according to any one of Statements 22-30, wherein the one or more aliphatic compound(s) comprising one or more nitriles is adiponitrile and the adiponitrile is initially present in the reaction mixture at a concentration of 3-35 wt %, including all 0.1 wt % values and ranges therebetween, the buffer is a phosphate buffer; the ion chelator is EDTA and the EDTA is initially present in the reaction mixture at a concentration of 0.1-5 wt % (based on the total weight of the electrolyte), including all 0.1 wt % values and ranges therebetween; the tetraalkyl amine is tetramethyl ammonium hydroxide and the tetraalkyl amine is initially present in the reaction mixture at a concentration of 0.1-5 wt % (based on the total weight of the electrolyte), including all 0.1 wt % values and ranges therebetween; and the remainder of the electrolyte comprises water.

Statement 32. A method according to any one of Statements 22-31, wherein the potential is a pulsed potential or constant potential waveform applied to the cathode.

Statement 33. A method according to any one of Statements 22-32, wherein the electrohydrogenation is performed in an electrochemical cell comprising the cathode.

Statement 34. A method according to Statement 33, wherein the electrochemical cell further comprises a metal anode comprising nickel, carbon steel, a platinum iridium-based dimensionally stable anode material, or the like, and, optionally, a reference electrode.

Statement 35. A method according to Statement 33, wherein the electrochemical cell further comprises a separator.

Statement 36. A method according to Statement 35, wherein the separator is a cation-exchange, anion-exchange, or bipolar membrane separating a cathode half-cell and an anode half-cell which are in electrical contact.

Statement 37. A method according any one of Statements 22-36, wherein the cathode has an electrochemically available surface comprising a metal, carbon, or the like, or a combination thereof.

Statement 38. A method according to Statement 37, wherein the metal is chosen from nickel, Raney nickel, palladium, cadmium, lead, gold, copper, silver, platinum, boron-doped diamond, iridium, carbon steel, and the like.

Statement 39. A method according to Statement 22-38, further comprising separation at least a portion of one or more aliphatic or aromatic compounds comprising one or more nitriles from the reaction mixture.

Statement 40. A method according to Statement 39, wherein the separation is a distillation or a liquid-liquid decantation to separate the aqueous from the organic phase.

The following example is presented to illustrate the present disclosure. It is not intended to be limiting in any matter.

Example

This example provides a description of methods and compositions of the present disclosure.

Using the hydrogenation of adiponitrile to hexamethylenediamine (HMDA), a monomer used in the production of nylon-6,6, the effect of reactant concentration, temperature, pH, and organic cosolvents on the ECH of nitrile groups with Raney nickel electrodes was investigated. Higher reactant concentrations, alkaline electrolytes, and mild temperature (40° C.) are key conditions that enhance the hydrogenation of organic substrates against hydrogen evolution. A maximum faradaic efficiency of 92% toward HMDA was obtained in aqueous electrolytes at −60 mA $cm^{-2}$. The addition of an organic cosolvent is subsequently studied to evaluate the effect of enhanced reactant solubility, achieving a 95% faradaic efficiency at the same current density with 30% methanol by volume in water. The insights gained from this study are relevant for the design of energy efficient organic ECH and can help accelerate the implementation of sustainable chemical manufacturing.

Herein, these strategies were deployed to gain insights into the effect of electrolyte composition and electrochemical operation conditions on the faradaic efficiency of HMDA on Rainey nickel electrodes and ultimately identify electrolyte formulations that enhance the performance of this reaction.

Results and Discussion.

The kinetic, mass transport, and ohmic limitations in the ECH of ADN can be strongly influenced by the composition of the electrolyte and reaction conditions. In the following sections, the effects of the reactant concentration, temperature, and pH are systematically studied to understand their impact on the reaction selectivity. The effect of organic cosolvents is subsequently investigated to identify potential improvements on reactant solubility and faradaic efficiency toward HMDA.

Figure 2:
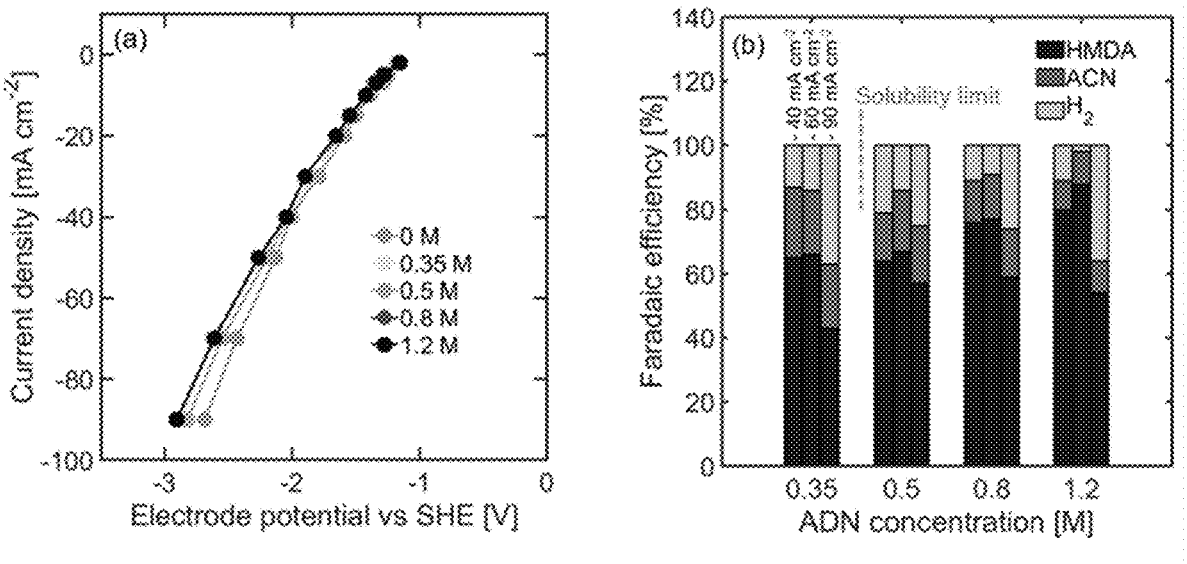
FIG. 2 shows (a) steady state polarization curve and (b) effect of reactant concentration and current density on the average faradaic efficiency towards HMDA, ACN, and $H_2$ (the standard deviation on all the reported efficiencies was <4%). The electrolyte contained 0.5 M $Na_3PO_4$, 0.02 M EDTA, 0.02 M TMA hydroxide. Temperature was kept at 25° C. and electrolyte pH at 12.

Effect of ADN Concentration. The reactant concentration can significantly affect the performance of organic electrochemical transformations in aqueous electrolytes. Larger bulk ADN concentrations can increase the reactant concentration in the electrical double layer (EDL), form a second organic-rich phase, and decrease the electrolyte ionic conductivity. In order to better understand the trade-off between these effects, the ECH of ADN was studied in electrolytes with ADN concentrations ranging between 0.35 and 1.2 M (FIG. 2). The aqueous electrolyte consisted of sodium phosphate as a supporting electrolyte, EDTA as a chelating agent, and tetramethylammonium (TMA) hydroxide to promote higher concentrations of organic reactants at the EDL, as explored in previous studies.

Although a second organic-rich phase was observed with ADN concentrations above 0.4 M, relatively small effects were observed in the steady state polarization curves (FIG. 2(*a*)) with and without an organic reactant. This suggests that proton reduction is modulating the electron transfer events at the electrode surface and that a high reactant concentration weakly affects the availability of water molecules in the EDL.

Figure 7:
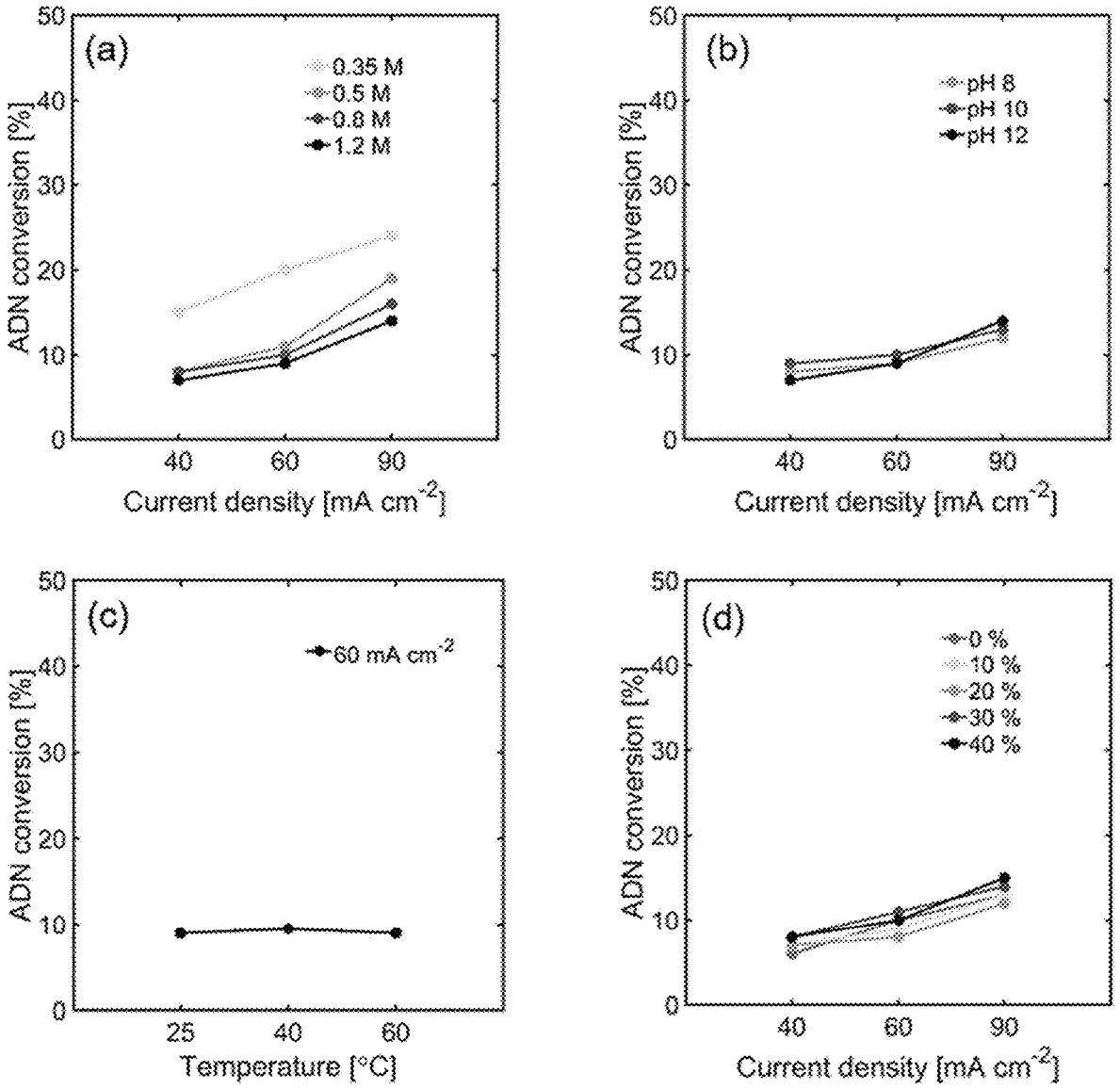
FIG. 7 shows reactant conversions for varying (a) ADN concentrations, (b) electrolyte pH, (c) temperature, and (d) methanol content with current densities.

FIG. 2(*b*) summarizes the effect of ADN concentration on the faradaic efficiency toward HMDA, ACN, and $H_2$. A mass balance showed that the production of HMDA and ACN accounted for >97% of the ADN converted, suggesting that no other organic byproducts were formed. The remaining charge transferred in each experiment was thus attributed to the $H_2$ evolution reaction (HER), the only other non-organic cathodic byproduct. The results showed an increase in $H_2$ production at higher current densities, suggesting that hydrogen gas generation becomes faster than the rate of the hydrogenation of organic substrates. This is likely the result of faster reaction rates at higher current densities, which leads to faster reactant consumption and can in turn reduce the local reactant concentration and organic surface coverage. Previous studies have observed a similar increase in $H_2$ generation at higher current densities due to changes in the surface coverage. HMDA production is thus enhanced with low-to-intermediate current densities, achieving the highest HMDA faradaic efficiency at −60 mA $cm^{-2}$ for all ADN concentrations. The faradaic efficiencies reported are also a consequence of the reactant conversion, which varies with the current density and reactant bulk concentration (see FIG. 7). Low conversions are desired to minimize variations on the reactant bulk concentration, but the experimental time of 2 h was selected to maintain conversions between 7 and 24%, since the NMR quantification accuracy severely suffered with conversions below 6%. Although the comparison of faradaic efficiencies is done under different reactant conversions, there is a <10% conversion difference on the values taken to compare the effect of the current density and concentration.

The faradaic efficiency toward HMDA increases with increasing ADN concentrations, suggesting that higher fluxes of the organic substrate to the cathode facilitate the complete reduction of the ADN nitrile groups while limiting the HER. The production rate of the partially hydrogenated product is also controlled at higher ADN concentrations, most likely as the result of a balance on diffusive fluxes of organic molecules between the electrode and bulk electrolyte. ACN production is also generally reduced with high reactant conversions, which favors the complete hydrogenation of the nitrile groups. However, faradaic efficiencies will vary in time under batch operation, and the values reported herein are average efficiencies over the time of each batch experiment. A maximum faradaic efficiency of 88% is found for electrolytes with the highest ADN concentration explored (1.2 M) at a current density of −60 mA $cm^{-2}$.

Effect of pH. The electrolyte pH determines the concentration of available protons for electrochemical and bulk reactions. A lower electrolyte pH can improve the kinetics of the proton reduction step, thus increasing the generation of adsorbed hydrogen atoms ($H_{ads}$). However, the pH effect on the selectivity is complex, as the higher surface concentration of Haas could enhance the HER rate instead of the hydrogenation of organic species.

Figure 3:
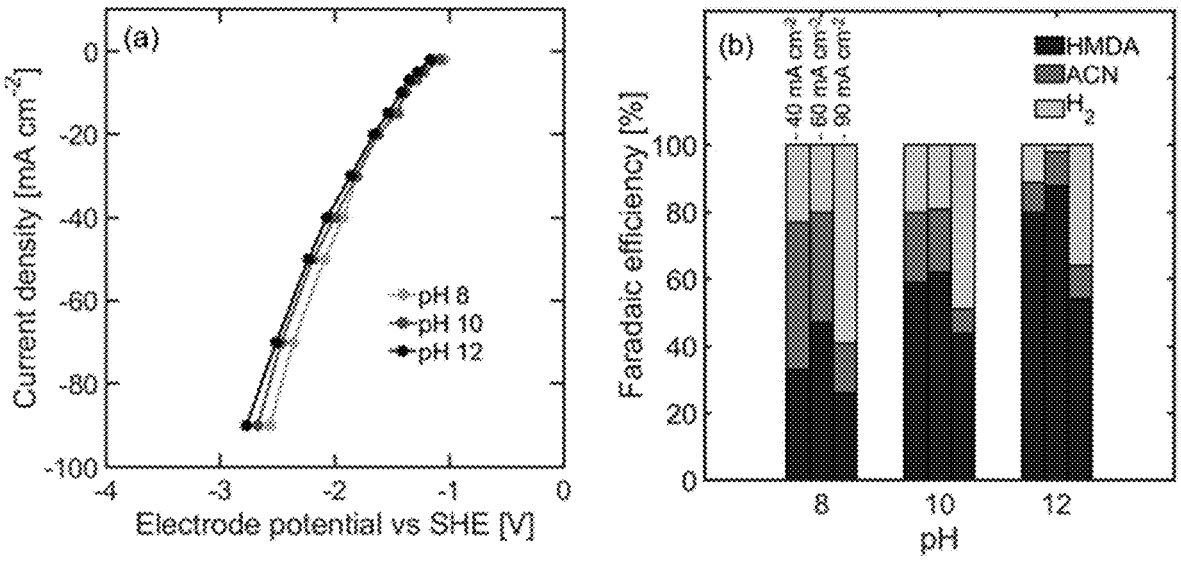
FIG. 3 shows (a) steady state polarization curve and (b) effect of electrolyte pH and current density on the average faradaic efficiency towards HMDA, ACN, and $H_2$ (the standard deviation on all the reported efficiencies was <3%). The electrolyte contained 0.5 M $Na_3PO_4$, 0.02 M EDTA, 0.02 M TMA hydroxide, and 1.2 M ADN. Temperature was kept at 25° C.
Figure 8:
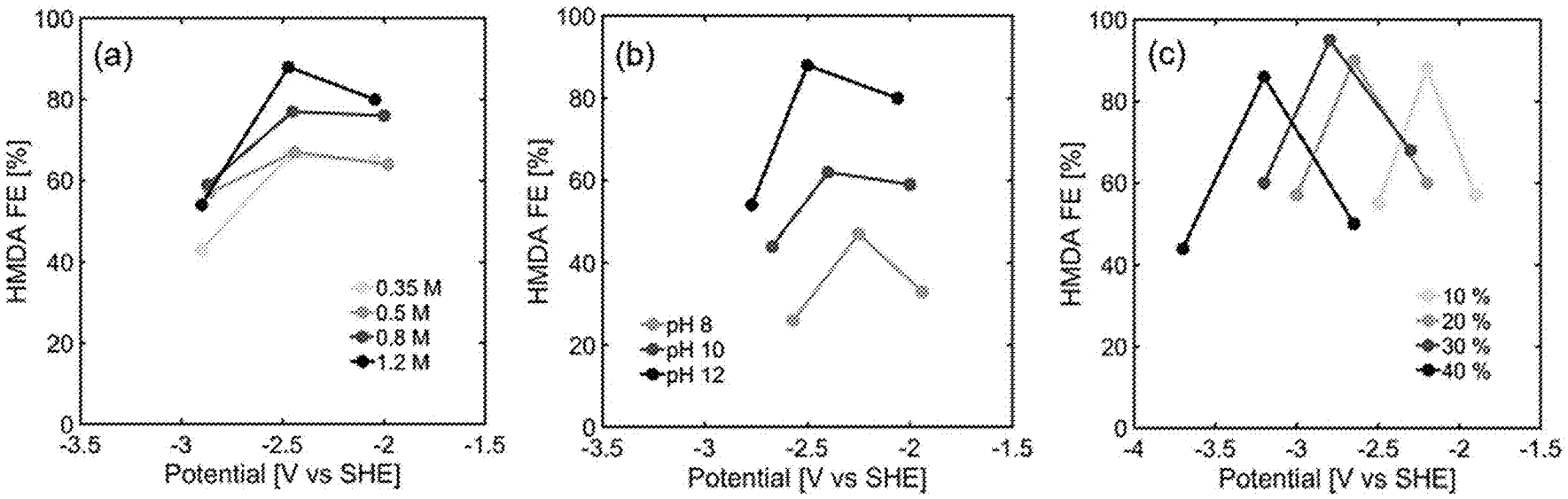
FIG. 8 shows Faradaic efficiency towards HMDA with varying (a) ADN concentration, (b) electrolyte pH, and (c) methanol (% v/v) content. For each line, the points correspond to −40, −60, and −90 mA $cm^{-2}$ with increasing potential.
Figure 9:
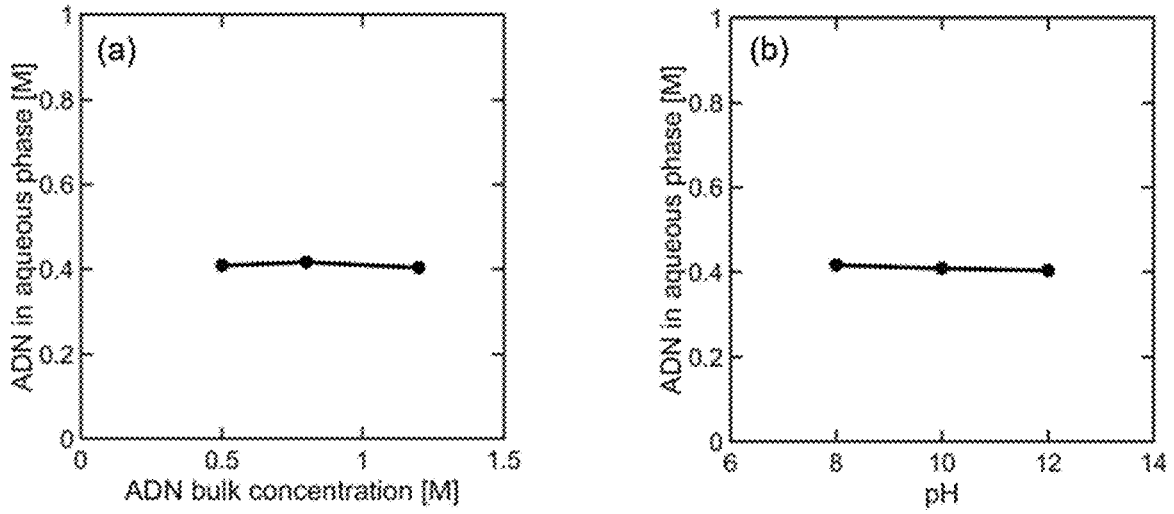
FIG. 9 shows solubilized ADN concentration with varying (a) ADN concentration and (b) electrolyte pH. Unless specified differently, the electrolyte contained 0.5 M $Na_3PO_4$, 0.02 M TMA hydroxide, 0.03 M EDTA, and 1.2 M ADN at pH 12.
Figure 10:
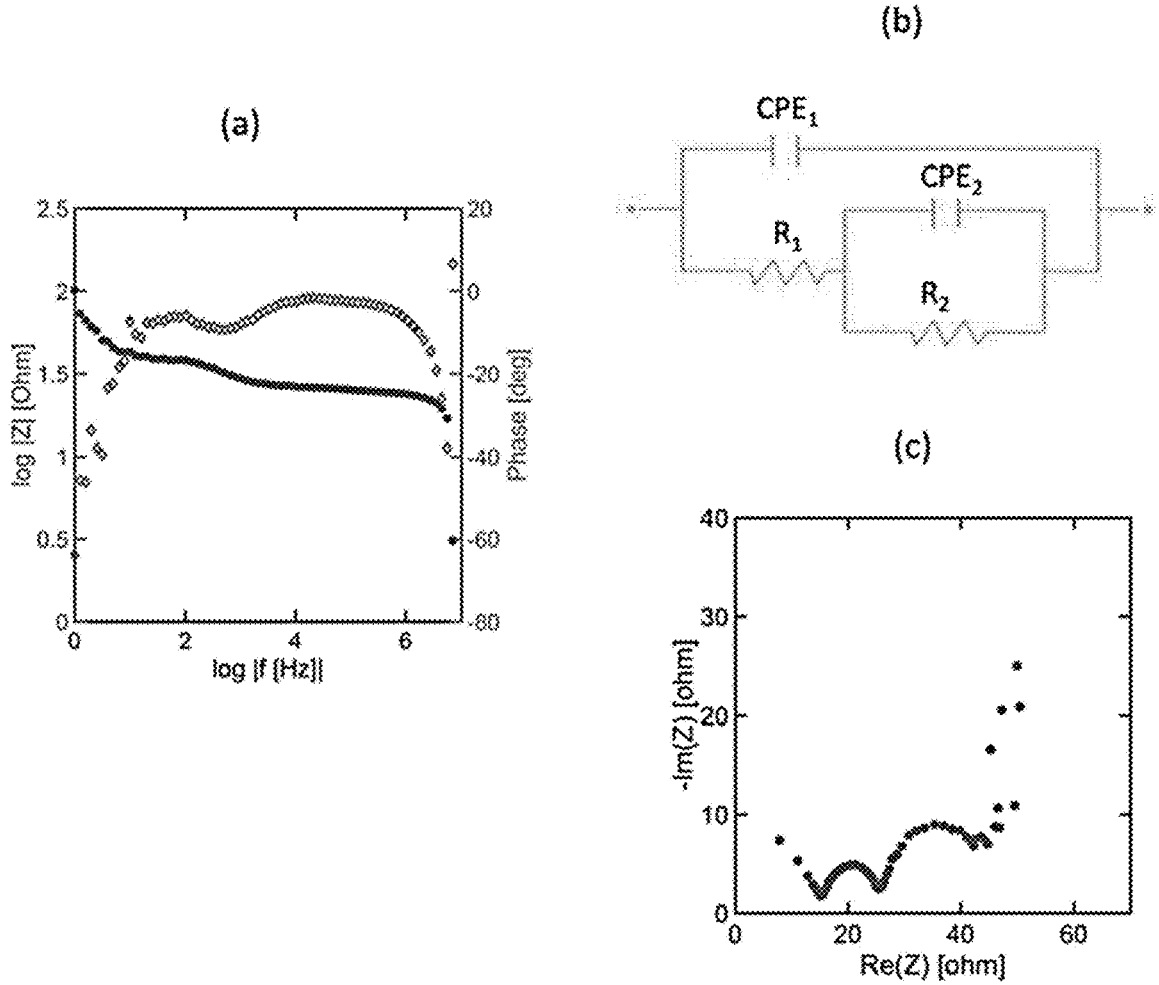
FIG. 10 shows (a) a Bode diagram, (b) proposed equivalent circuit, and (c) Nyquist plot for 10 mV sinus amplitude from 7 MHz to 1 Hz. Electrolyte contained 0.5 M $Na_3PO_4$, 0.02 M TMA hydroxide, 0.03 M EDTA, and 0.6 M ADN. Temperature was maintained at 25° C. and pH at 12.

FIG. 3(*a*) shows the effect of electrolyte pH on the steady state polarization curves. There is a slight decrease in the overpotential at a lower pH, which could suggest that proton reduction, the main driver of the electron transfer rate, is facilitated by a higher proton concentration. On the other hand, FIG. 3(*b*) shows the significant effect that pH has on the faradaic efficiency. Despite the lower proton concentration at a higher pH, the partial hydrogenation of ADN to ACN is limited, while the complete hydrogenation to HMDA is favored. The increase in the faradaic efficiency toward HMDA with a higher pH at all current densities is also expected to be maintained with electrode potential, as shown in FIG. 8. This effect on the hydrogenation of organic molecules could be due to variations on the surface coverage of reduced protons at different pH conditions. A lower surface coverage of adsorbed hydrogen is expected under alkaline conditions, owing to slower water dissociation kinetics, further increasing the adsorption of water or organic molecules on the electrode surface and favoring the hydrogenation of organic substrates, while limiting the HER. No significant variations were observed in the solubilized ADN concentration (see FIG. 9), suggesting that the effect of pH on the product distribution is not a consequence of variations in the organic solubility. Finally, the lower bulk proton availability at higher electrolyte pH values also helps limit the HER, demonstrating that basic electrolytes are required to maintain high faradaic efficiency toward HMDA.

Effect of Temperature. The reaction temperature can strongly influence reaction kinetics and mass transport in electrochemical hydrogenations. Higher temperatures increase the electrolyte conductivity, reactant solubility, diffusion coefficient of species, and electrode reaction rates. These effects can reduce energy losses, yielding lower electrode potentials at higher temperature, as is observed in FIG. 4.

Figure 4:
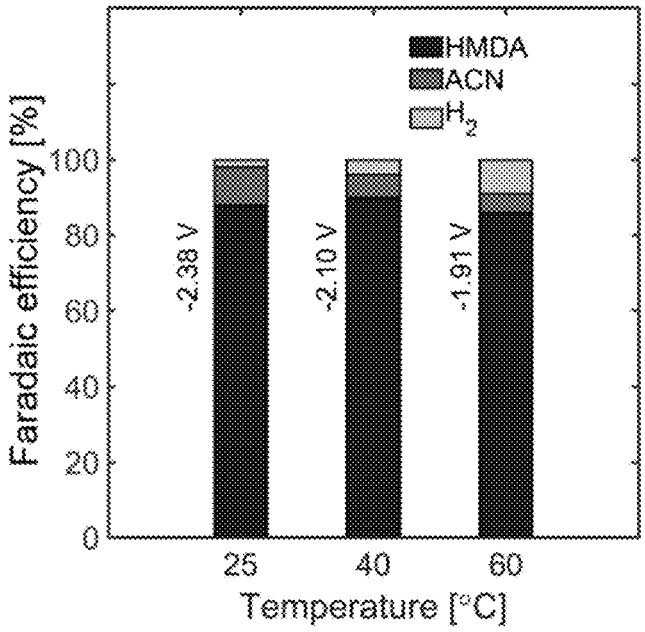
FIG. 4 shows the effect of temperature on the average faradaic efficiency towards HMDA, ACN, and $H_2$ at −60 mA $cm^{-2}$ (the standard deviation on all the reported efficiencies was <4%). The electrolyte contained 0.5 M sodium phosphate, 0.03 M EDTA, 0.02 M TMA hydroxide, and 1.2 M ADN. Electrolyte pH was maintained at 12. The effect of temperature on the electrode potential (vs SHE) is shown next to every bar.

Although reaction overpotentials can be reduced with higher temperatures, FIG. 4 shows no significant effect on the faradaic efficiency. A slight increase of the faradaic efficiency toward HMDA is observed at 40° C., likely due to the improved reactant solubility and the enhanced reactant flux toward the reaction surface. Stronger hydrogen evolution is observed at higher temperatures, suggesting a larger increase on water splitting kinetics and $H_2$ evolution. A maximum of 92% faradaic efficiency toward HMDA is found at 40° C.

Effect of Organic Cosolvent. Although aqueous electrolytes are benign and offer inherent cost advantages, organic cosolvents can improve the reactant solubility and enhance mass transfer rates of organic molecules to the electrode, at the expense of reduced electrolyte conductivity. In the case of organic ECH, water is a source of protons in the reaction, and thus the incorporation of alcohols in the electrolyte can lower the proton concentration and affect reaction overpotentials. In order to understand the effect of organic cosolvents in the ECH of ADN to HMDA, varying concentrations (0-40% volume) of methanol cosolvent were studied.

Figure 5:
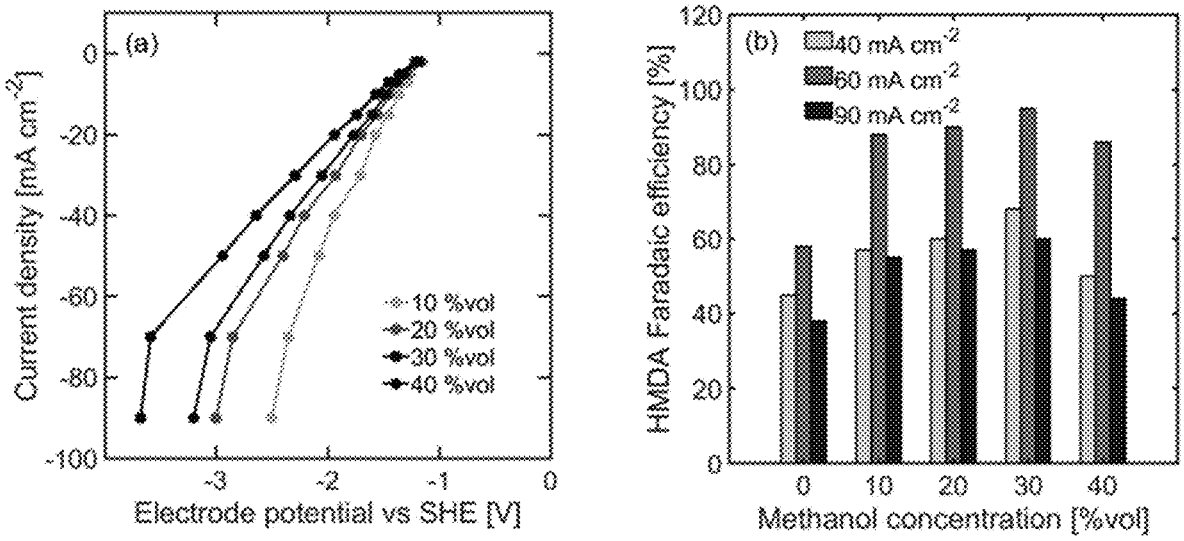
FIG. 5 shows the effect of methanol concentration on the (a) steady state polarization curve and (b) average faradaic efficiency towards HMDA and electrolyte pH with varying methanol concentration (the standard deviation on all the reported efficiencies was <4%). The electrolyte contained 1.5 M sodium acetate, 0.03 M EDTA, 0.02 M TMA hydroxide, and 1.2 M ADN. Temperature was kept at 25° C. and electrolyte pH at 8.
Figure 11:
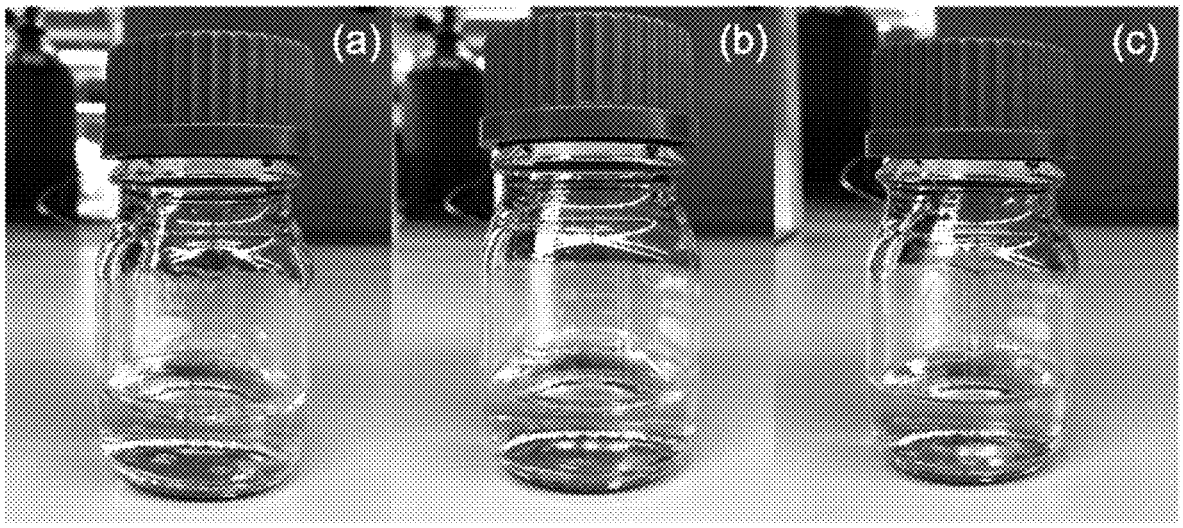
FIG. 11 shows an electrolyte solution with (a) 10, (b), 30, and (c) 40% methanol volume. The electrolyte contained 1.5 M sodium acetate, 0.03 M EDTA, 0.02 M TMA hydroxide, and 1.2 M ADN.
Figure 12:
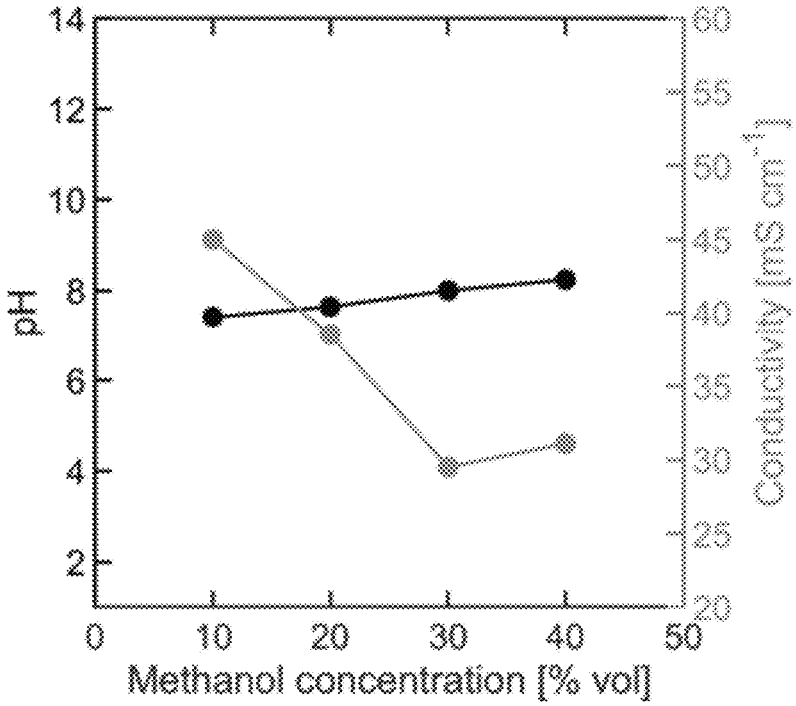
FIG. 12 shows electrolyte pH and conductivity with varying methanol concentration. The electrolyte contained 1.5 M sodium acetate, 0.03 M EDTA, 0.02 M TBA hydroxide and 1.2 M ADN. Temperature was maintained at 25° C.

Increasing the methanol concentration improved the solubility of ADN in the electrolyte, reaching complete miscibility for methanol concentrations >40% by volume (see FIG. 11). FIG. 5(*a*) shows the effect of an organic cosolvent on the steady state polarization curves. A significant increase in the overpotential is observed for higher methanol concentrations. This could be due to the lower proton concentration (observed pH increase from 7.4 to 8.3 with increasing methanol content) and the reduced concentration of water molecules, which act as the main proton source (FIG. 5(*a*)). Although the electrolyte conductivity decreased from 45 to 31 mS $cm^{-1}$ (see FIG. 12) for the same range of methanol concentrations, this is not reflected on the polarization curves, as they have been compensated for ohmic losses (see below for calculation details).

Figure 13:
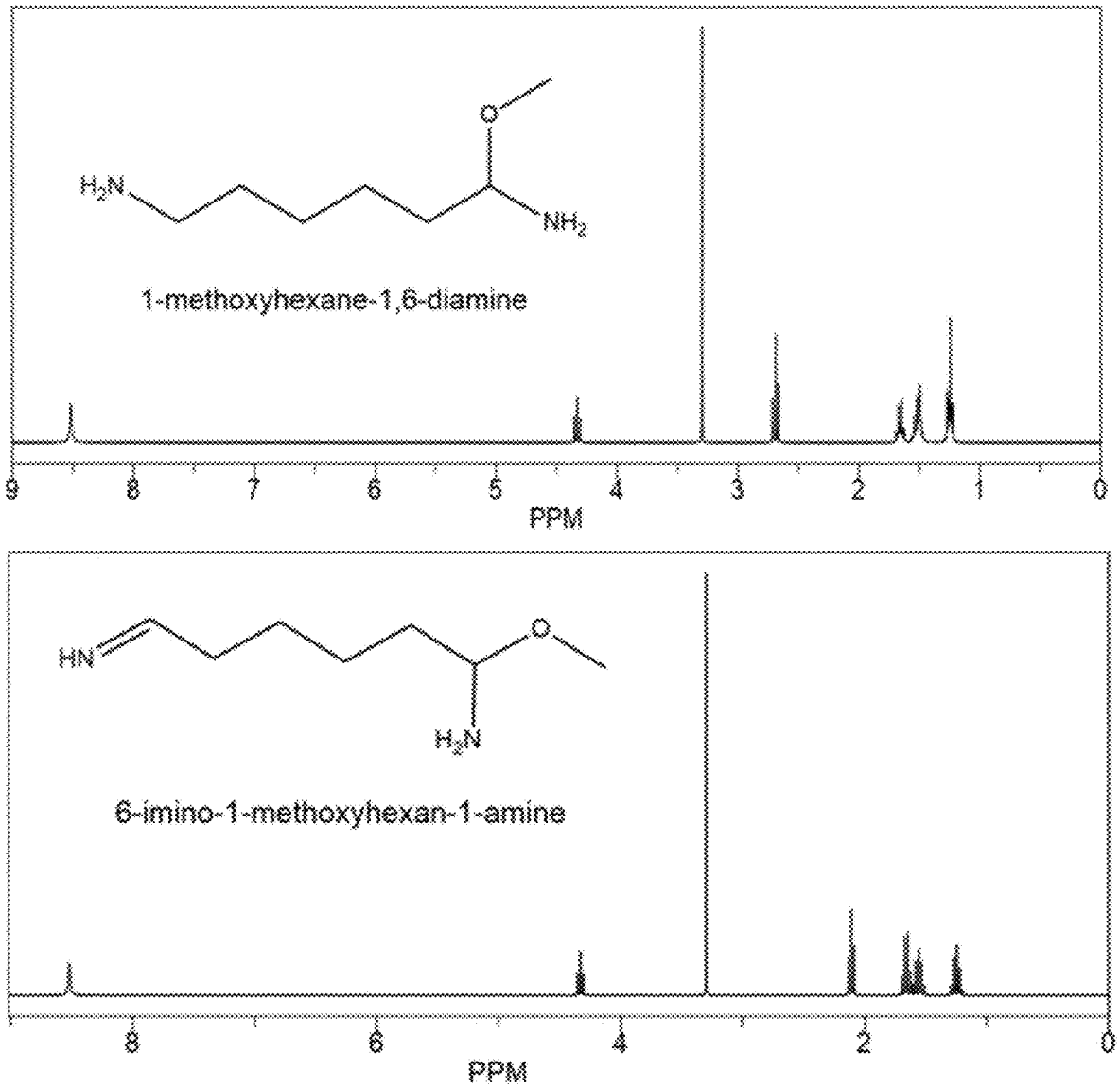
FIG. 13 shows modeled NMR spectra and structure of potentially formed methoxi-amines from the homogeneous reaction of alcohols and amines.
Figure 14:
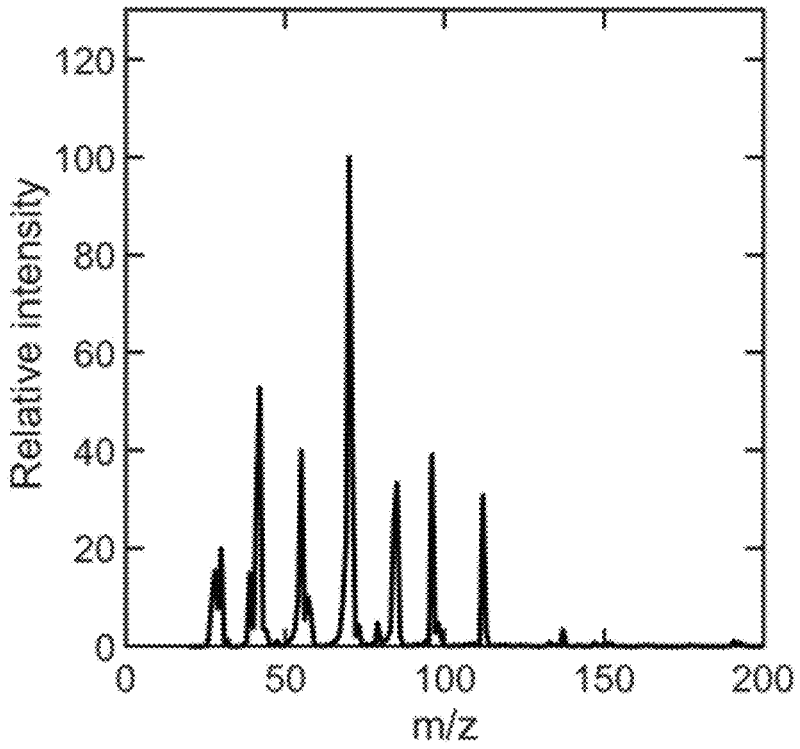
FIG. 14 shows a mass spectrum of undesired product from the electro-hydrogenation of ADN to HMDA at 40% vol of methanol co-solvent.

FIG. 5(*b*) summarizes the variations on the faradaic efficiency toward HMDA with methanol concentration. Faradaic efficiencies toward ACN are not reported in this case, as their quantification was not accurate. The collected GCMS and NMR spectra (see below) strongly suggest that methoxyamines are formed with a high methanol content from the homogeneous reaction of imines and alcohols. The NMR spectra of these methoxyamines (see FIG. 13) overlapped with that of ACN.

Figure 15:
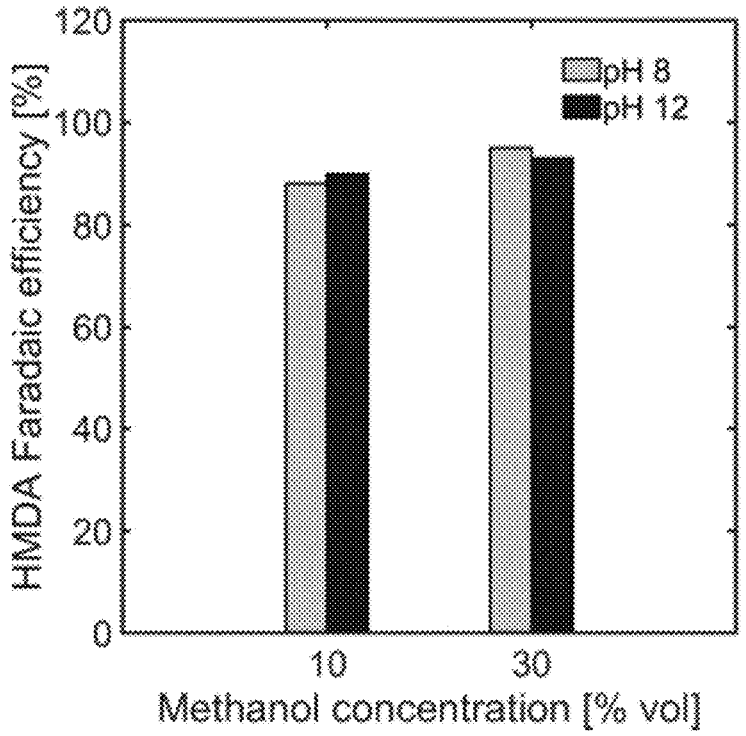
FIG. 15 shows the effect of electrolyte pH on the faradaic efficiency (2% experimental error) to HMDA with varying methanol concentration. The electrolyte contained 1.5 M sodium acetate, 0.02 M TMA hydroxide, 0.6 M ADN, and 0.03 M EDTA. The temperature was maintained at 25° C.
Figure 16:
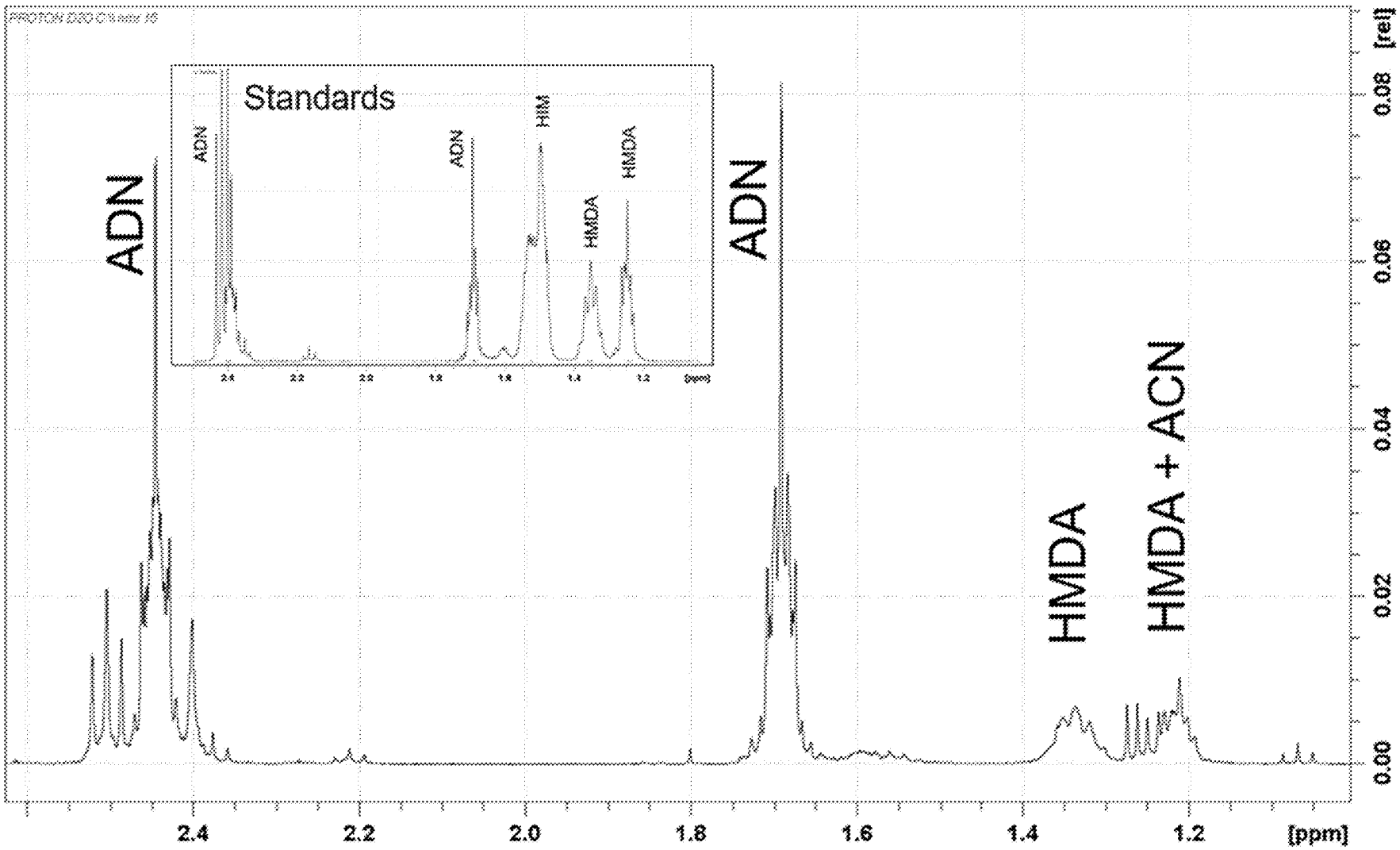
FIG. 16 shows NMR spectra from standard samples of ADN, HMDA, and hexamethyleneimine (HIM), purchased from Sigma Aldrich and sample NMR spectra from 60 mA $cm^{-2}$ in an aqueous electrolyte with 0.5 M sodium phosphate, 0.03 M EDTA, 0.02 M TMA hydroxide, and 1.2 M ADN.

It is important to note that sodium phosphate was not soluble at 0.5 M in the presence of methanol. Sodium acetate was thus used as the supporting electrolyte, maintaining the cation molarity in the system. FIG. 5(*b*) shows a faradaic efficiency of 58% for 0% methanol by volume at −60 mA $cm^2$, which is notably lower than the 85% obtained with 1.2 M ADN in phosphate-based aqueous electrolytes. This is likely due to the lower electrolyte pH (i.e., pH 8 with acetate versus pH 12 with phosphate). There is, however, an important increase of the faradaic efficiency with the addition of the organic cosolvent at a fixed current density, reaching an unprecedented maximum faradaic efficiency of 95% with 30% methanol by volume (Table 1). Once methanol is added in the electrolyte, no significant variations were observed in the faradaic efficiency with the electrolyte pH (see FIG. 15). Although the addition of methanol can improve the reactant solubility and favor HMDA formation, the results suggest that there is a drop in the faradaic efficiency for higher methanol concentrations, most likely owing to the loss of HMDA and intermediates to methoxyamines in homogeneous reactions.

TABLE 1

Summary of the System Performance and Experimental Conditions for Previous Systems on the ECH of ADN to HMDA, where the italicized entry is the present disclosure.

| Year | Electrode | Electrolyte | Performance |
|---|---|---|---|
| 1961 | Spongy Ni | Aqueous, HCl-based 20° C. | 60% yield |
| 1965 | Raney Ni | Aqueous, NaOH-based 5-8° C. | <40% faradaic efficiency |
| 1972 | Raney Ni | Ethanol-based 25° C. | 45% faradaic efficiency |
| 1982 | Raney Ni | Methanol-based 25° C. | 56% faradaic efficiency |
| 1990 | Raney Ni | Aqueous, alcohol-based −25 ° C. | 30% faradaic efficiency |
| *2020* | *Raney Ni* | *Aqueous 25° C., methanol-based 25° C.* | *88% faradaic efficiency, 95% faradaic efficiency* |

Conclusions. Introduced herein is a systematic approach for the development of an efficient ECH route to HMDA in aqueous electrolytes. The characteristics of steady state polarization curves are dictated by proton reduction kinetics, which can be affected at high organic concentrations due to the lower proton availability. Hydrogen evolution and the formation of the partially hydrogenated amine (ACN) are the main competing reactions. Two-phase electrolytes with high reactant concentrations led to higher faradaic efficiencies to HMDA, suggesting that the high reactant concentration near the electrode surface is critical to promote the addition of hydrogen to the organic substrate. Low-to-intermediate current densities favored HMDA formation, and higher current densities strongly favored $H_2$ evolution. The HER and ACN formation were also significantly favored at intermediate pH values (i.e., pH of 8-10), highlighting the need for an alkaline electrolyte pH, and lower proton concentrations, to limit the main side reactions and to increase HMDA production. As shown in Table 1, a maximum of 88% faradaic efficiency was found at room temperature, a pH of 12, 1.2 M ADN, and −60 mA $cm^{-2}$. A 92% faradaic efficiency was further achieved by increasing the reaction temperature to 40° C., while higher temperatures began to limit HMDA formation, owing to a stronger enhancement in the kinetics of hydrogen evolution.

Given that HMDA production is favored at reactant concentrations above the solubility limit, the addition of methanol as an organic cosolvent (10-40% volume) was studied. The addition of the methanol cosolvent led to an increase in the reaction overpotential, likely due to a lower availability of water molecules. Although there was a drop in the electrolyte conductivity (45 to 31 mS $cm^{-1}$) from 10 to 40% methanol by volume, the enhanced solubility of ADN appears to have improved the reactant flux to the electrode, achieving a 95% faradaic efficiency with 30% methanol by volume. A decrease in the faradaic efficiency is observed for higher methanol concentrations, likely due to the loss of organic intermediates to methoxyamines formed in bulk reactions with methanol. The insights provided by this work can help mitigate the main obstacles in the implementation of the large-scale organic ECH of nitriles in benign aqueous electrolytes, further contributing to the deployment of safer and more sustainable processes for chemical manufacturing.

Experimental

Materials. All chemicals used were acquired from Sigma-Aldrich, including nickel(II) sulfate hexahydrate, ammonium chloride, boric acid, aluminum nickel catalyst (30-70 μm particle diameter), sodium hydroxide, hydrochloric acid, sodium phosphate, ethylenediaminetetraacetic (EDTA) acid disodium salt, tetramethylammonium (TMA) hydroxide, sodium acetate, deuterium oxide, ethylene glycol, HMDA, and ADN.

A fresh aqueous solution with 0.5 M sodium phosphate, 0.03 M EDTA, and 0.02 M TMA hydroxide was prepared with 0.2-1.2 M ADN for each experiment, unless specified differently. This aqueous solution was used as a catholyte and 1 M sulfuric acid as an anolyte. A Nafion 117 membrane from the Nafion Store was used to separate the anodic and cathodic compartments. No significant pH changes were measured throughout the course of the experiment, suggesting negligible acid crossover through the membrane.

A 1 $cm^2$ nickel foil (American Elements) was used as the substrate for the electrodeposition of the Raney nickel catalyst. A platinum mesh (Alfa Aesar) was used as a counter electrode and a Ag/AgCl reference electrode (Pine Instruments) in 4 M KCl as the reference electrode.

Electrode Preparation. Raney nickel electrodes were electrodeposited from an electrolyte containing 4 g of aluminum nickel (AlNi) catalyst dispersed in a 50 mL aqueous solution of 0.8 M nickel(II) sulfate, 0.3 M ammonium chloride, and 0.2 M boric acid, as reported in the literature. A nickel foil was pretreated for 5 min in 8 M sodium hydroxide and for 5 min in 1 M hydrochloric acid in order to remove the impurities from the electrode surface. The electrolyte solution was vigorously stirred (at 1200 rpm with a 1 cm long stirring bar) to maintain the AlNi particles suspended in the solution. The temperature was maintained at 40° C. during the electrodeposition process. A current density of −40 mA $cm^2$ was applied for 80 min, and the electrode was subsequently leached in a 5 M sodium hydroxide solution for 2 h. The Raney nickel electrodes were prepared and stored in deionized water for 24 h before use. Each electrode was operated for 12 h, and no significant variations of the faradaic efficiency were observed throughout this time under pH 12 electrolytes. The electrode geometrical area (1 $cm^2$) was used for the calculation of the apparent current densities that are reported throughout the manuscript.

Electrochemical Characterization. The effects of electrolyte composition, temperature, and current density on the ECH of ADN to HMDA were studied using a three-electrode setup. Electrochemical impedance spectroscopy (EIS) and chronopotentiometry (CP) were performed using a BioLogic VSP-300 potentiostat. EIS experiments were performed with frequencies varying from 7 MHz to 1 Hz and an amplitude of 10 mV to determine the ohmic drop between the working and reference electrodes. CP was carried out for 2 h, leading to ADN conversions between 7 and 24%, depending on the current density.

Figure 6:
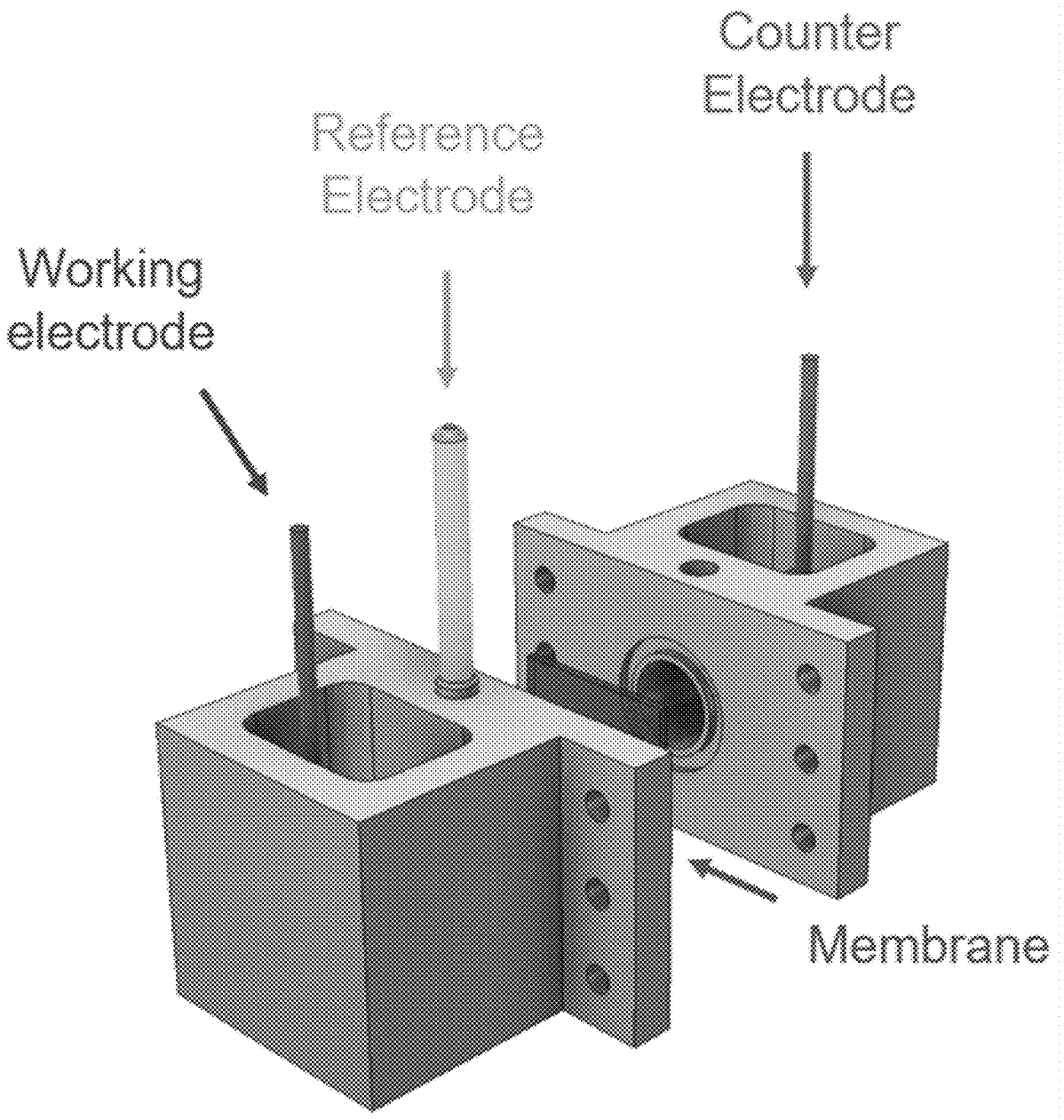
FIG. 6 shows a schematic of H-cell used, showing the working, counter, and reference electrodes. Cathodic and anodic chambers are separated by an ion exchange membrane.

All experiments were carried out in a machined Teflon H-cell with a Nafion 117 membrane separating the two chambers to avoid the deposition of metal ions from the anodic chamber onto the cathode surface and to facilitate the study of phenomena taking place at the cathode (see FIG. 6 for a cell sketch). Viton O-rings were used to seal the membrane between the two chambers.

A constant electrolyte volume of 8 mL was used for each experiment, and the temperature was controlled using a hot plate and a sand bath. The catholyte was continuously stirred (at 700 rpm with 0.7 cm long stirring bar) in all experiments.

Chemical Analysis. NMR samples consisting of 200 μL of catholyte solution, 750 μL of deuterium oxide, and 50 μL of ethylene glycol were prepared. The analysis was performed using a Bruker Avance III 400 NMR. Standard samples were used to identify peaks and chemical shifts in the spectra (see below for details). Product quantification was performed by calculating the hydrogen equivalents from ethylene glycol (details below). The characterization of methoxyamines was also performed using a Shimadzu gas chromatographer equipped with a mass spectrometer GCMSQP2010. A B30PCI CVR SympHony meter was used to measure the electrolyte conductivity and pH. Faraday's law was used to correlate the applied current in each experiment to the consumption/generation of each species. Further details on the calculations for HMDA faradaic efficiency are shown below.

Faradaic efficiency calculations. Faradaic efficiency towards HMDA and by-products was calculated using the following equation:

$$FE_k = \frac{Q_k}{Q_{total}} \tag{1}$$

where $FE_k$ corresponds to the faradaic efficiency towards species k. The total charge ($Q_{total}$) is calculated as the current density multiplied by the total experimental time in seconds. The charge used for the production/consumption of species k ($Q_k$) is obtained through Faraday's law:

$$n_k = \frac{i_k t}{n F} = \frac{Q_k}{n F} \tag{9}$$

where $n_k$ corresponds to the moles of species k consumed or produced, n to number of electrons involved in the reaction, i to the current in A, t to the time in s, and F to Faraday's constant.

IR compensation calculations. All reported working electrode potentials on the manuscript accounted for the IR compensation ($IR_{comp}$), and reported values were calculated according to the following equation:

$$E_{WE}=E_{app}+E_{RE}-IR_{comp}$$

where $E_{WE}$ and $E_{RE}$ correspond to the potential at the working and reference electrode, respectively, and $E_{app}$ corresponds to the applied voltage. All IR drop compensations were performed after experiments were carried out.

Standard reaction potential calculations. Standard reaction potentials were calculated from Gibbs free energy values obtained from the literature.

Cathodic Half-Cell Reaction $$ADN+8e^{-}+8H_2O \rightarrow HMDA+8OH^{-}$$

$\Delta G°HMDA=132.54$ KJ/mol
$\Delta G°ADN=253.31$ KJ/mol
$\Delta G°H_2O=-237.14$ KJ/mol
$\Delta G°OH=-157.2$ KJ/mol $$E^{\circ} = \frac{\Delta G^{o}_{rxn}}{-nF} = \frac{518750\,J/\text{mol}}{-8\cdot 96485\,C/\text{mol}} = -0.67\,V\ vs\ SHE$$

Anodic Half-Cell Reaction $$8\,OH^{-} \rightarrow 4H_2O + 2O_2 + 8e^{-}$$

$$E^{\circ} = \frac{\Delta G^{\circ}_{rxn}}{-\text{nF}} = \frac{309040\ J/\text{mol}}{-8\cdot 96485\,C/\text{mol}} = -0.4\,V\ vs\ SHE$$

EIS measurements. The solution resistance was obtained from the low x-intercept from a semi-circle fit on the EIS data. The equivalent circuit proposed is characteristic of two-phase systems and has already been studied for oil emulsions in water. For this system, the proposed equivalent circuit consists of a resistor in parallel with a constant phase element for each time constant.

Undesired methoxyamines in organic co-solvents. The mass spectrum shows a molecular weight of approximately 150 g $mol^{-1}$ from the molecular ion and mass to charge ratios of fragments detailed in the chromatogram. This is very similar to the molecular weight of the methoxyamines described above (146 and 144 g $mol^{-1}$), or other variations of partially hydrogenated methoxyamines resulting from the undesired bulk reaction of amines and alcohols.

Although the present disclosure has been described with respect to one or more particular embodiments and/or examples, it will be understood that other embodiments and/or examples of the present disclosure may be made without departing from the scope of the present disclosure.

The invention claimed is:

1. A electrohydrogenation method for making a compound comprising one or more amine groups and/or imine groups, wherein the compound comprising one or more amine groups and/or imine groups is aliphatic or aromatic, comprising:

contacting a reaction mixture having an initial pH of 7 to 13 with a cathode, wherein the reaction mixture comprises:

one or more aliphatic or aromatic compounds comprising one or more nitriles at an initial concentration of 3-35 wt %; and an electrolyte comprising:

a buffer salt;

an ion chelator;

a tetraalkyl amine; and water; and applying a potential with a current density of 10-1,000 mA $cm^{a}$ to the cathode, wherein at least one nitrile of the one or more aliphatic or aromatic compounds are hydrogenated such that one or more amine group(s) and/or imine group(s) are formed.

2. The method of claim 1, wherein the aliphatic or aromatic compound comprising one or more nitriles is a small molecule or a polymer.

3. The method of claim 1, wherein the aliphatic or aromatic compound comprising one or more nitriles is aliphatic and is chosen from adiponitrile, azelanitrile, butyronitrile, and combinations thereof.

4. The method of claim 3, wherein the aliphatic or aromatic compound comprising one or more nitriles is adioponitrile.

5. The method of claim 1, wherein the initial concentration of the aliphatic or aromatic compound comprising one or more nitriles is 5-15 wt %.

6. The method of claim 1, wherein the buffer salt is chosen from phosphate buffers, acetate buffers, borate buffers, acetate buffers, and combinations thereof and the buffer salt concentration is 5 to 20 wt % (based on the total weight of the electrolyte).

7. The method of claim 1, wherein the ion chelator is chosen from ethylene diamine tetraacetic acid/tetraacetate (EDTA), borax, and combinations thereof and the ion chelator is at least initially present in the reaction mixture at a concentration of 0.1-5 wt % (based on the total weight of the electrolyte).

8. The method of claim 1, wherein the tetraalkyl amine is chosen from $R_4N^{+}A^{-}$, wherein R is independently at each occurrence an $C_1$, $C_2$, $C_3$, $C_4$, $C_5$, or $C_6$ alkyl group and $A^{-}$ is an anion chosen from hydroxide, phosphate, acetate, chloride, and combinations thereof.

9. The method of claim 8, wherein the tetraalkyl amine is at least initially present in the reaction mixture at a concentration of 0.1-5 wt % (based on the total weight of the electrolyte).

10. The method of claim 1, wherein the one or more aliphatic compound(s) comprising one or more nitriles is adiponitrile and the adiponitrile is initially present in the reaction mixture at a concentration of 3-35 wt %, the buffer is a phosphate buffer;

the ion chelator is EDTA and the EDTA is initially present in the reaction mixture at a concentration of 0.1-5 wt % (based on the total weight of the electrolyte);

the tetraalkyl amine is tetramethyl ammonium hydroxide and the tetraalkyl amine is initially present in the reaction mixture at a concentration of 0.1-5 wt % (based on the total weight of the electrolyte); and the remainder of the electrolyte comprises water.

11. The method of claim 1, wherein the potential is a pulsed potential or constant potential waveform applied to the cathode.

12. The method of claim 1, wherein the electrohydrogenation is performed in an electrochemical cell comprising the cathode.

13. The method of claim 12, wherein the electrochemical cell further comprises a metal anode comprising nickel, carbon steel, or a platinum iridium-based dimensionally stable anode material, and, optionally, a reference electrode.

14. The method of claim 12, wherein the electrochemical cell further comprises a separator.

15. The method of claim 14, wherein the separator is a cation-exchange, anion-exchange, or bipolar membrane separating a cathode half-cell and an anode half-cell which are in electrical contact.

16. The method of claim 1, wherein the cathode has an electrochemically available surface comprising a metal, carbon, or a combination thereof.

17. The method of claim 16, wherein the metal is chosen from nickel, Raney nickel, palladium, cadmium, lead, gold, copper, silver, platinum, boron-doped diamond, iridium, and carbon steel.

18. The method of claim 1, further comprising separation at least a portion of one or more aliphatic or aromatic compounds comprising one or more nitriles from the reaction mixture.

19. The method of claim 18, wherein the separation is a distillation or a liquid-liquid decantation to separate the aqueous from the organic phase.

* * * * *